US005934822A

United States Patent [19]

Green

[11] Patent Number: 5,934,822

[45] Date of Patent: Aug. 10, 1999

[54] SYSTEM FOR INSTALLING RAISED ROAD MARKERS

[75] Inventor: John L. Green, Sedro Woolley, Wash.

[73] Assignee: Accrued, Inc., Olympia, Wash.

[21] Appl. No.: 08/947,589

[22] Filed: Oct. 9, 1997

[51] Int. Cl.[6] ..... E01C 23/18

[52] U.S. Cl. ..... 404/94

[58] Field of Search ..... 404/93, 94

[56] References Cited

U.S. PATENT DOCUMENTS

| | | | |
|---|---|---|---|
| 3,540,358 | 11/1970 | Oakley | 94/39 |
| 3,590,701 | 7/1971 | Ten Broeck | 94/39 |
| 3,864,052 | 2/1975 | Blomberg | 404/94 |
| 4,089,730 | 5/1978 | Mahn | 156/541 |
| 4,136,991 | 1/1979 | Clark et al. | 404/73 |
| 4,279,534 | 7/1981 | Eigenmann | 404/72 |
| 4,322,177 | 3/1982 | Eigenmann | 404/83 |
| 4,369,001 | 1/1983 | Eigenmann | 404/94 |
| 4,373,670 | 2/1983 | Kilner | 239/172 |
| 4,623,280 | 11/1986 | Stenemann | 404/94 |
| 4,681,480 | 7/1987 | Eigenmann | 404/14 |
| 4,792,259 | 12/1988 | Eigenmann | 404/73 |
| 4,936,485 | 6/1990 | Downing | 221/297 |
| 4,974,990 | 12/1990 | Anderson et al. | 404/94 |
| 5,092,658 | 3/1992 | Smith | 299/39 |
| 5,503,499 | 4/1996 | Thomas et al. | 404/72 |
| 5,605,381 | 2/1997 | Schmoock, Jr. et al. | 299/39.2 |
| 5,676,490 | 10/1997 | Nelson | 404/94 |

OTHER PUBLICATIONS

Report: "An Investigation of New Marker Adhesive Processes for Botts' Dots", University of California, California DOT (Mar. 31, 1995).

Application: "Telerobotic Pavement Marker Application", L. Bernold, North Carolina State University, Mar. 1996.

Parts Price List: Automation Devices, Inc., Fairview, PA (Jan. 1, 1994), Issue 0194.

Bulletin: Automation Devices, Inc., Model 6000 Series Controller, Issue 0292.

Brochure: Schwarze Industries—Schwarze S343–G (1995).

Report: "Automated Raised Pavement Marker Machine (Conveyor System)", University of California (Jun. 30, 1992).

*Primary Examiner*—James A. Lisehora
*Attorney, Agent, or Firm*—Joan H. Pauly

[57] ABSTRACT

A mounting rail extends longitudinally along a vehicle. An installation head is mounted on the vehicle in a position fixed relative to the rail and adjacent to a first end portion of the rail. The head has a setting station from which road markers may be dispensed down onto a roadway. A glue dispenser assembly is slidably mounted on the rail. The assembly includes a dispenser with a nozzle, an anchor, and an anchor actuator. The assembly has a forward index position on a second end portion of the rail. The actuator is operable to move the anchor down into engagement with the roadway to prevent movement of the assembly relative to the roadway. A return actuator is connected to the assembly to allow the assembly to slide along the rail when the anchor is down and to positively move the assembly forwardly along the rail to return it to the index position.

15 Claims, 23 Drawing Sheets

FIG. 1
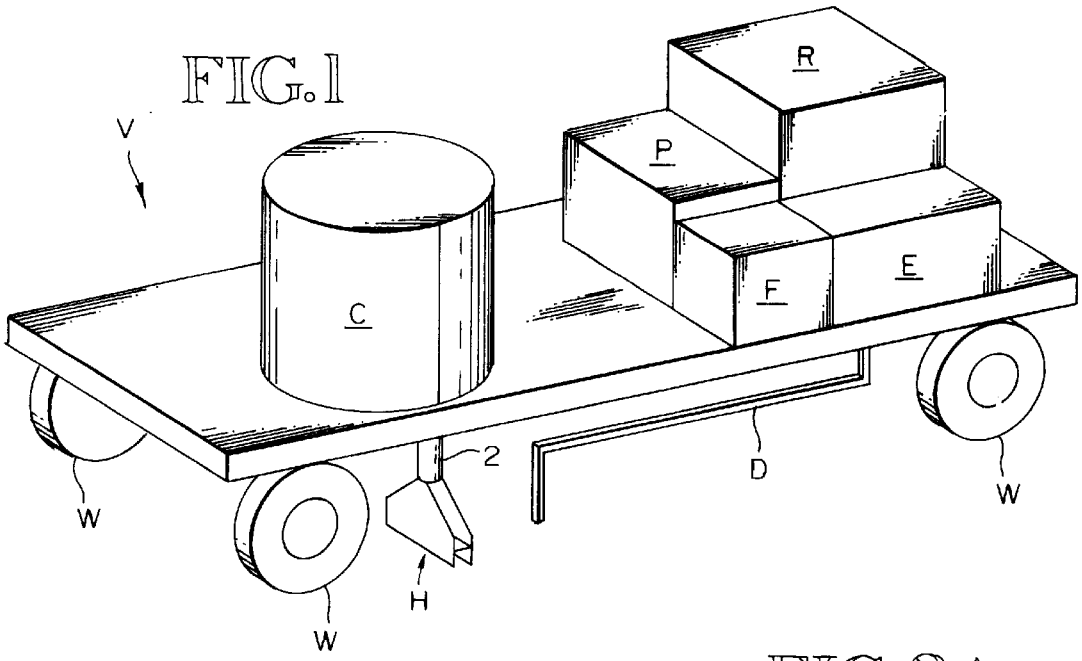
FIG. 2A
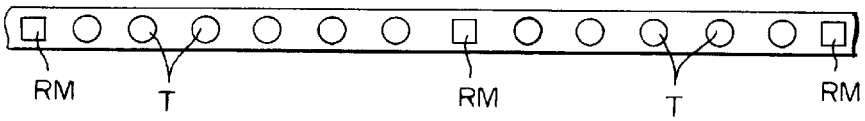
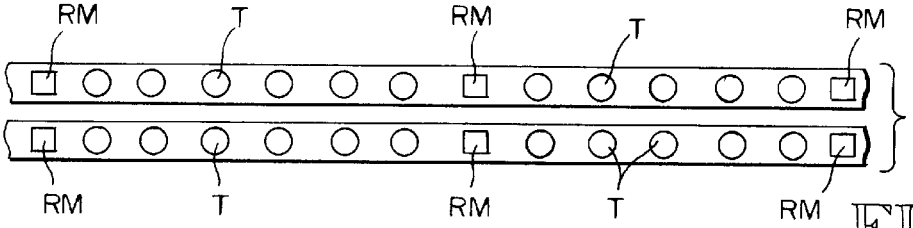
FIG. 2B
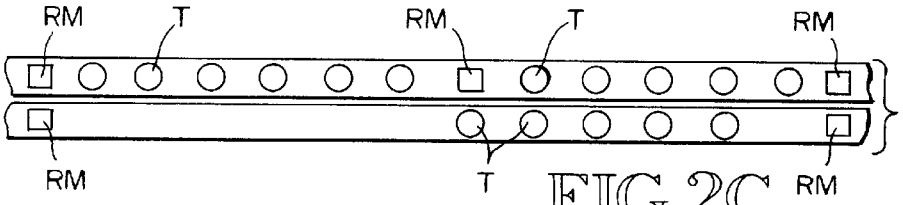
FIG. 2C
FIG. 4A
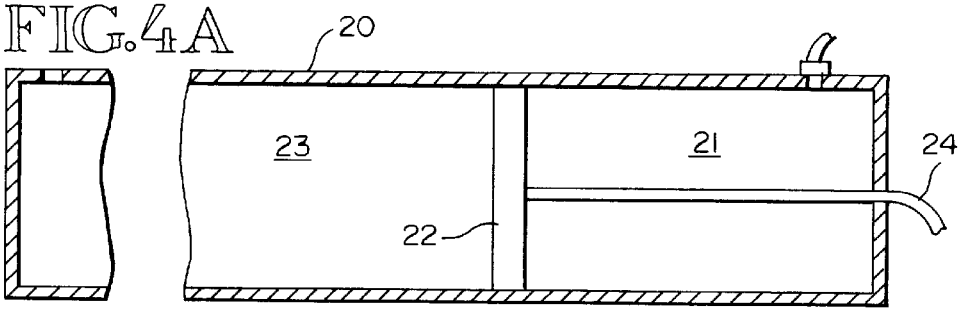

FIG. 8
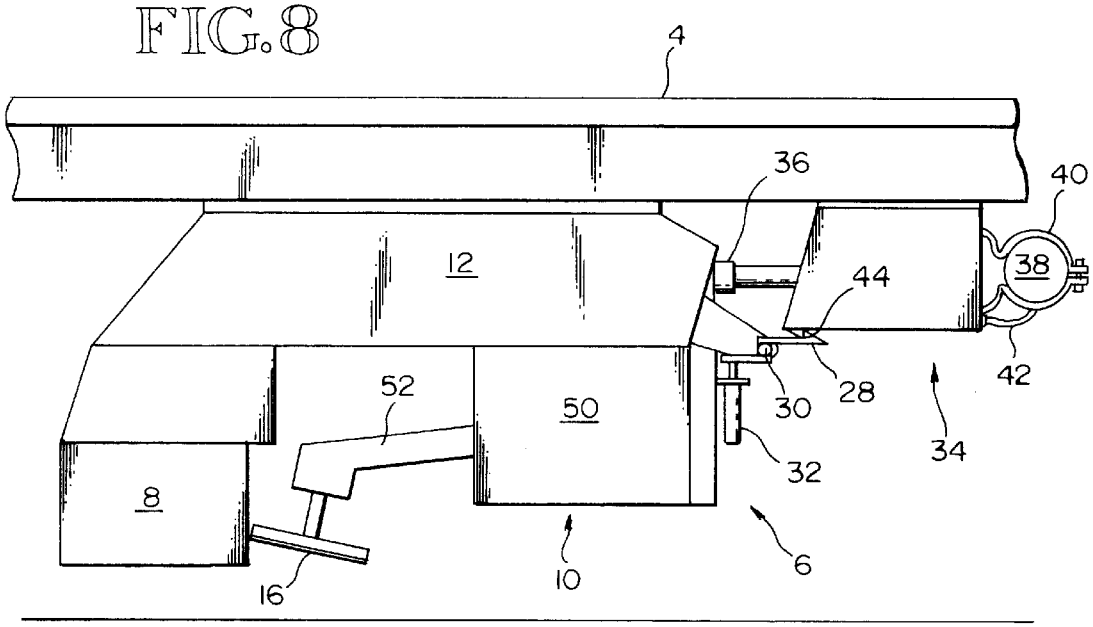
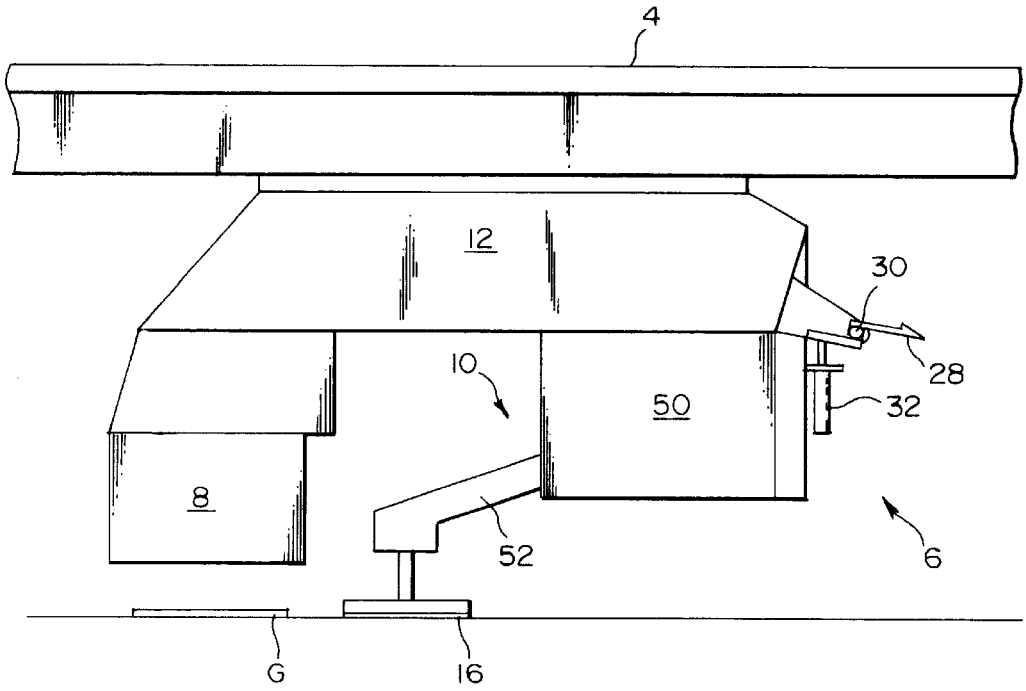
FIG. 9

FIG. 18
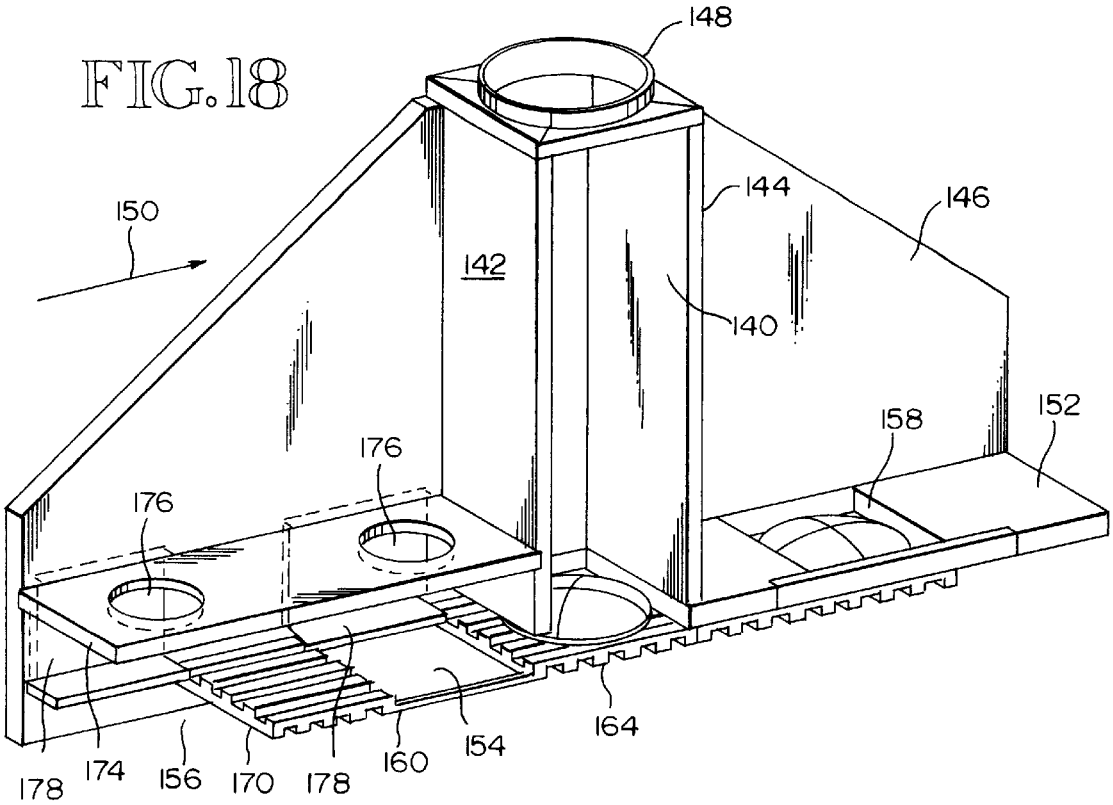
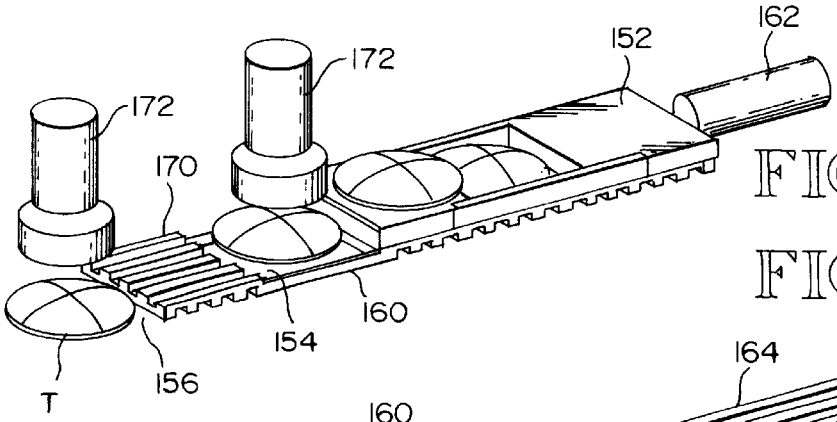
FIG. 19
FIG. 20
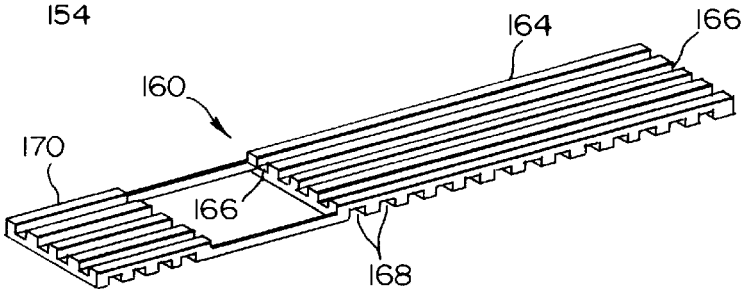
FIG. 21
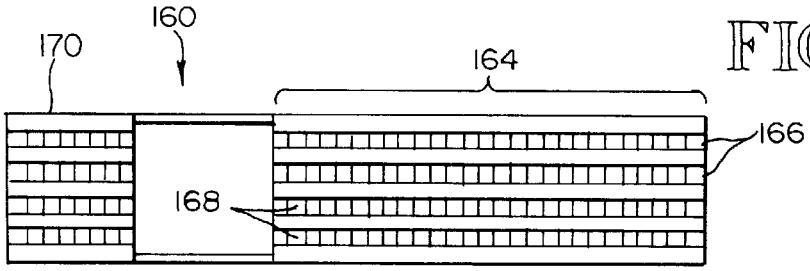

FIG. 29
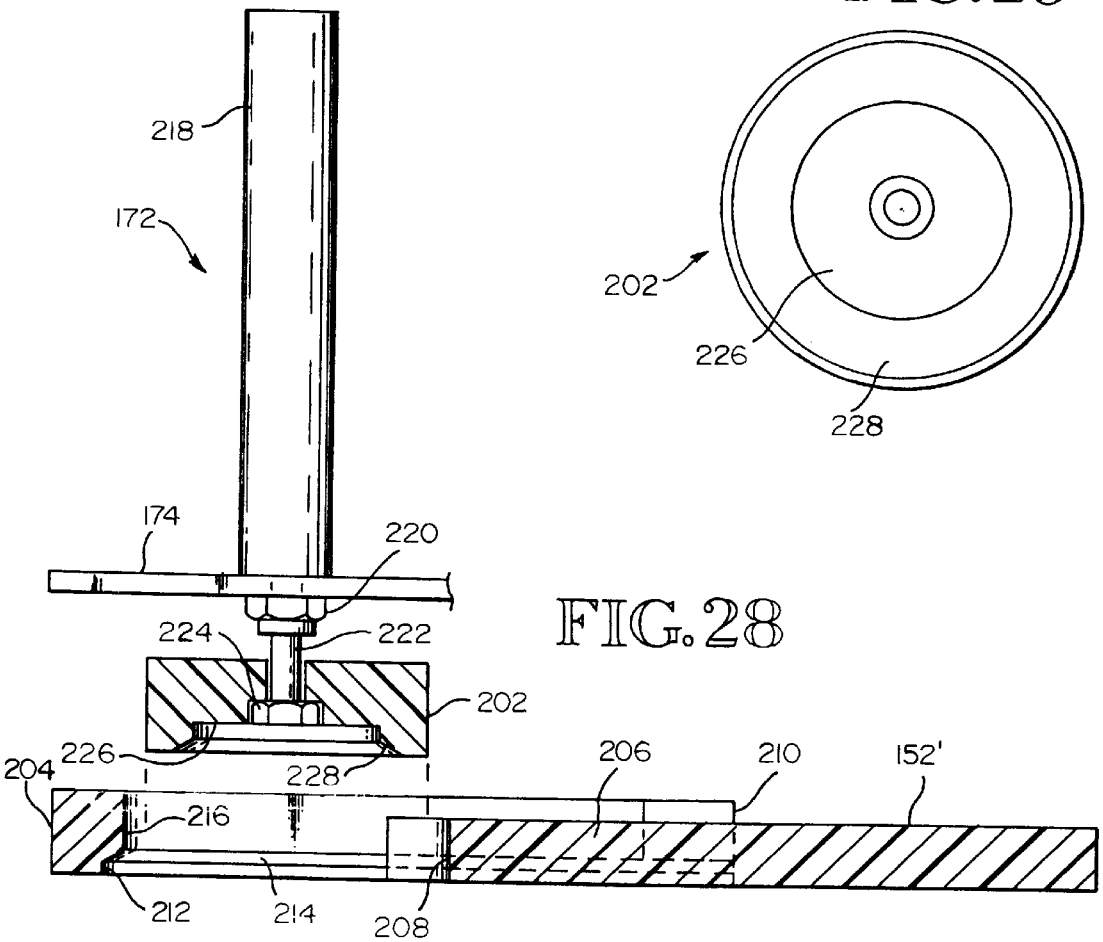
FIG. 28
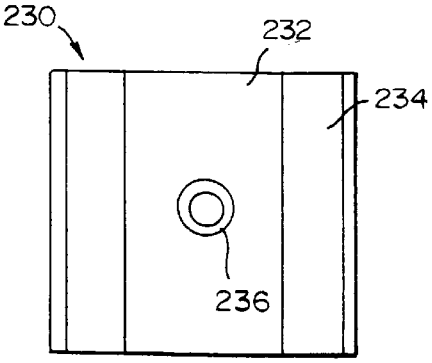
FIG. 30
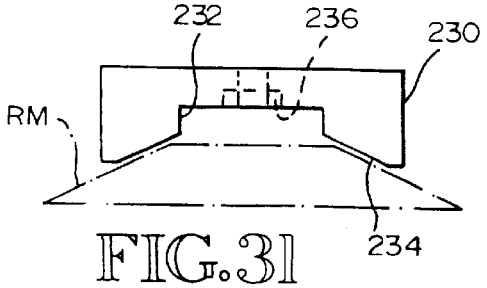
FIG. 31

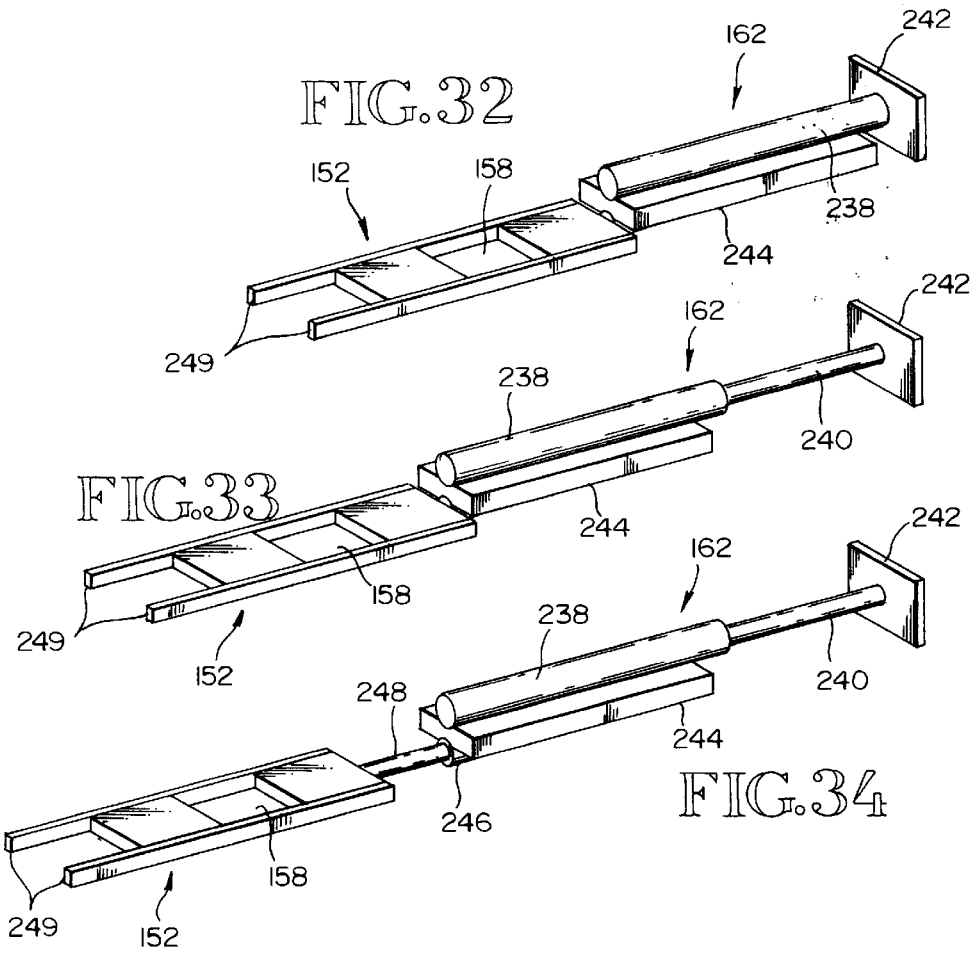
FIG.32
162
242
152
158
238
244
249
FIG.33
162
242
238
240
244
158
249
152
FIG.34
162
242
238
240
248
244
246
158
249
152
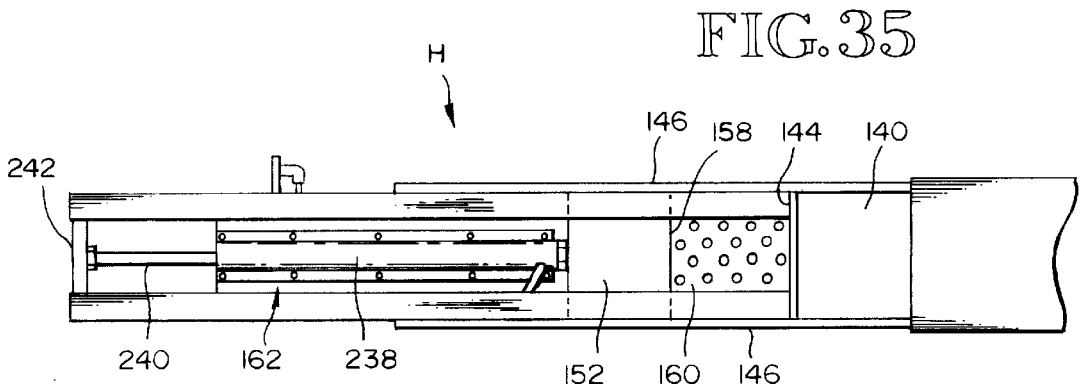
FIG.35
H
146
158
144
140
242
240
162
238
152
160
146

FIG. 40
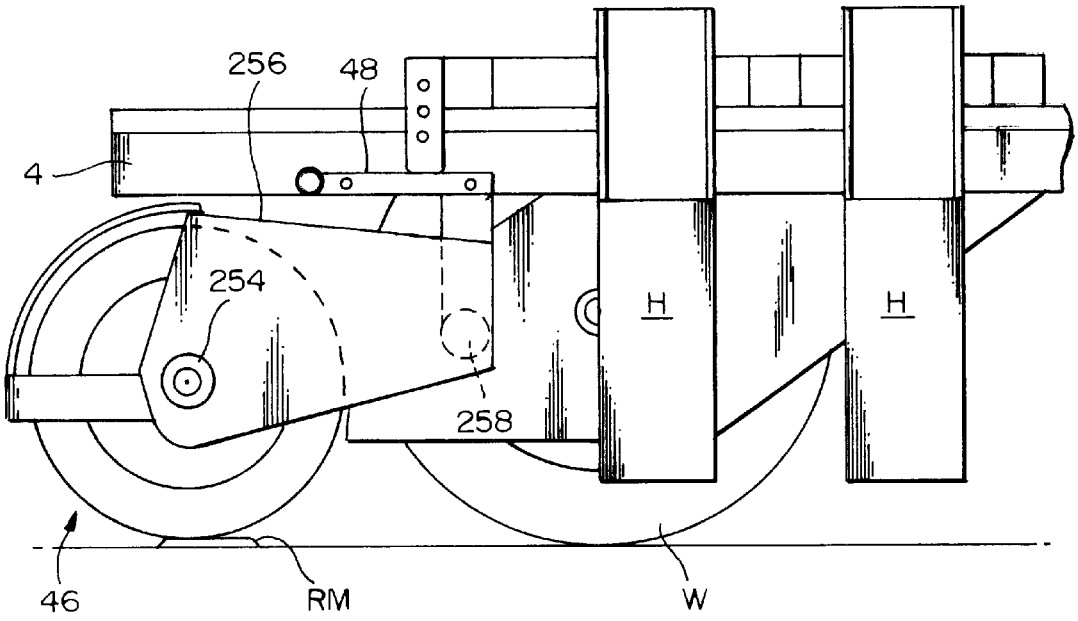
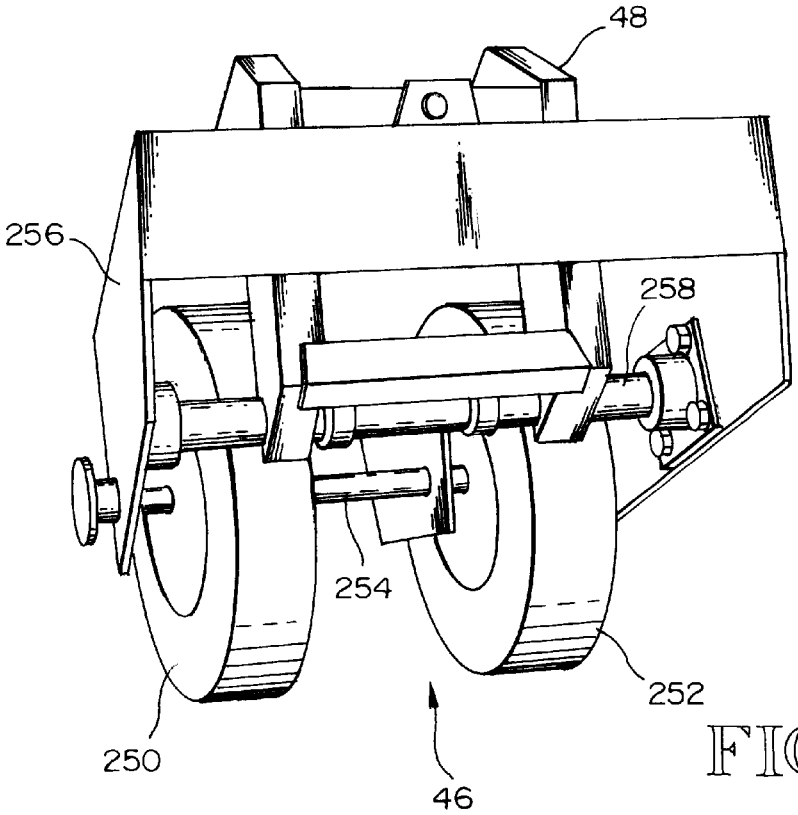
FIG. 41

FIG. 42
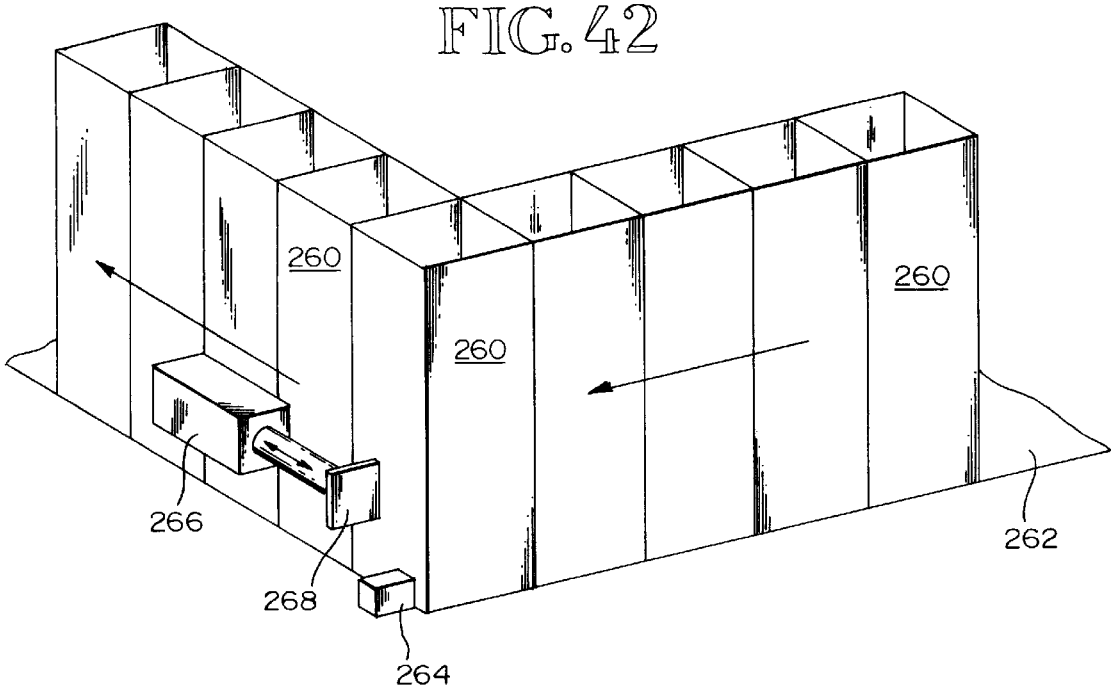
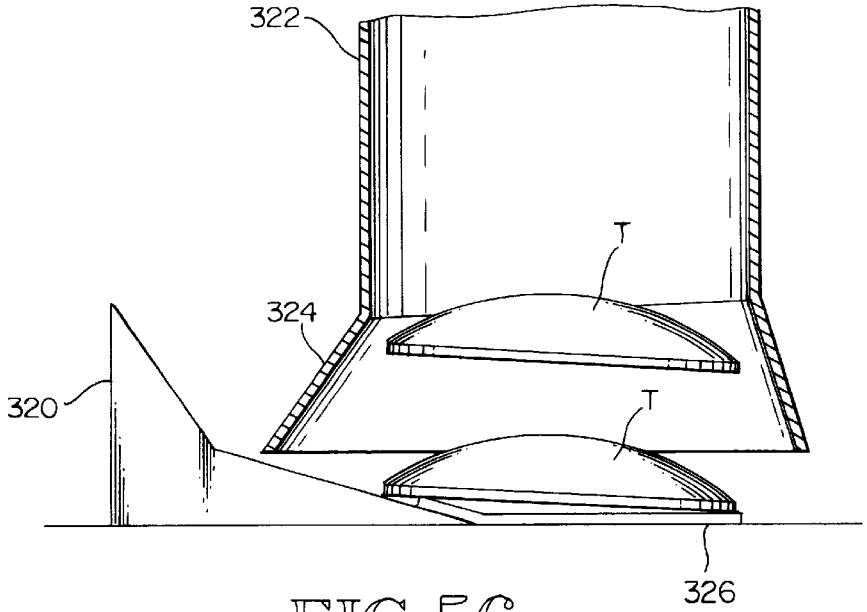
FIG. 56

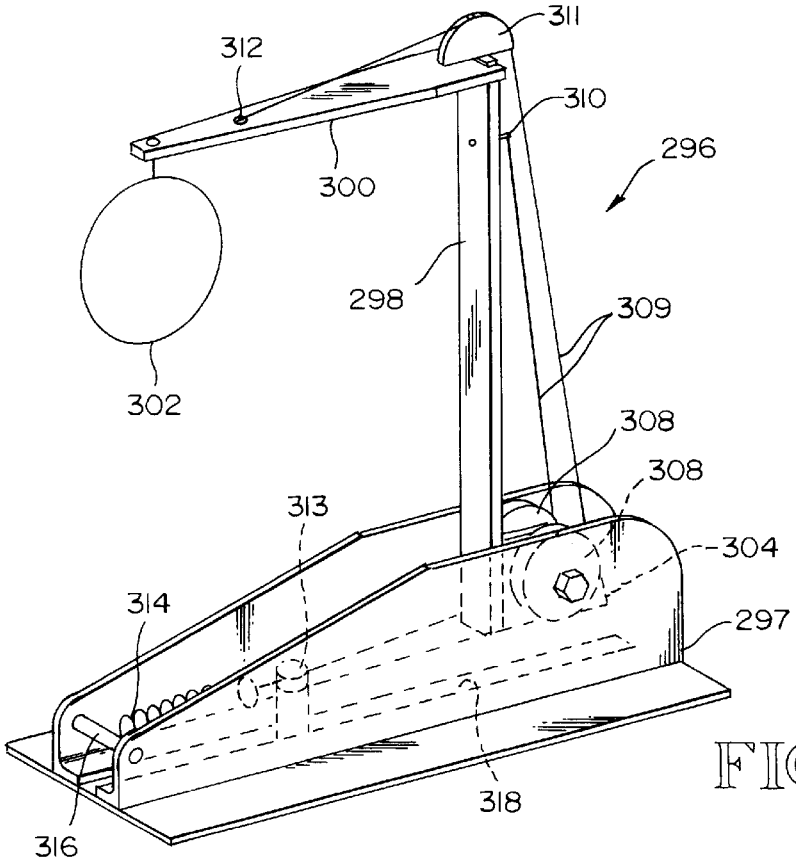
FIG. 45
FIG. 46
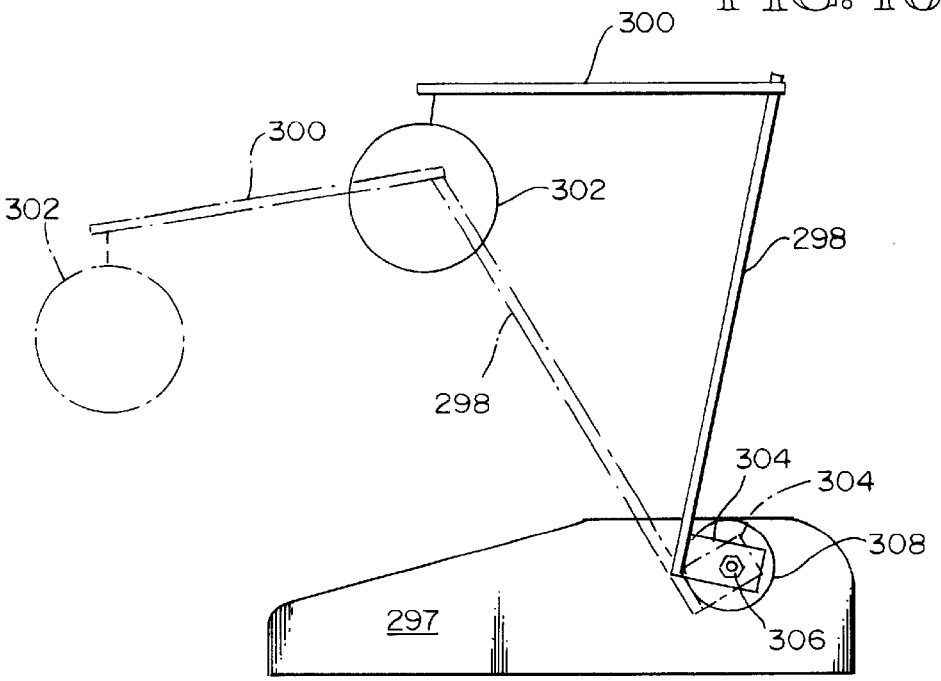

RM
393
394
396
398
400
392
388
390
404
406
178
184
156'
154'
361
380
382
384
385
386
360

SYSTEM FOR INSTALLING RAISED ROAD MARKERS

TECHNICAL FIELD

This invention relates to apparatus for automated installation of raised road markers. More particularly, the invention relates to installation apparatus including a mounting rail attachable to a vehicle, an installation head mountable in a fixed position relative to the rail, a glue dispenser assembly slidably mounted on the rail and having an anchor for holding the assembly in a fixed position relative to the roadway during dispensing of glue, and a return actuator for returning the assembly to an index position.

BACKGROUND INFORMATION

The systems currently in use for installing raised road markers on a roadway have a number of serious drawbacks. These drawbacks include high labor requirements and thus high labor costs, slow speed of installation and consequent low productivity, and especially worker safety concerns. One of the primary sources of concerns for worker safety is the necessity of having a worker stationed in a position relatively exposed to traffic. The installation procedures currently in use are not automated or are incompletely automated. Therefore, a worker is commonly placed in a position adjacent to the roadway to permit the worker to manually place adhesive and/or markers onto the roadway. If, as commonly is the case, the roadway is not closed to traffic, traffic passes in close proximity to the worker. When hot melt adhesives are used, the worker is also subjected to the hazard of handling high temperature materials. In addition, the lack of automation is not conducive to accurate installation of markers because of the vulnerability of the procedures to human error.

SUMMARY OF THE INVENTION

The subject of the invention is apparatus for installing raised road markers on a roadway. According to an aspect of the invention, the apparatus comprises a longitudinally extending mounting rail attachable to a vehicle and having opposite first and second end portions. An installation head is mountable on the vehicle in a position fixed relative to the rail and adjacent to the first end portion. The installation head has a setting station from which markers may be dispensed down onto a roadway. A glue dispenser assembly is slidably mounted on the rail. The assembly includes a dispenser having a nozzle through which glue may be ejected onto a roadway, and an anchor having a down position and an up position. In the down position, the anchor engages a roadway along which the vehicle is traveling. In the up position, the anchor is out of engagement with the roadway. The assembly also includes an anchor actuator operatively connected to the anchor to move the anchor between the down and up positions. The assembly has a forward index position on the second end portion of the rail. A return actuator is operatively connected to the assembly to allow the assembly to slide rearwardly along the rail from its index position toward the installation head when the anchor is moved into its down position, and to positively move the assembly forwardly along the rail to return the assembly to the index position when the anchor is moved into its up position.

Preferably, the apparatus further comprises a shock absorber fixed relative to the rail. The shock absorber is positioned to cushion and arrest sliding movement of the assembly as the assembly slides forwardly into its index position.

The return actuator may take various forms. Preferably, it comprises a single acting pneumatic cylinder having a pressure chamber continuously connected to a source of pressure to continuously bias the assembly toward its index position. In the preferred embodiment, a piston head is slidable within the pneumatic cylinder and defines one end of the pressure chamber. A flexible cable has one end secured to the piston head and a second opposite end secured to the glue dispenser assembly.

A preferred feature of the invention is an indexing hook arrangement for accurately positioning the assembly in its index position. The apparatus comprises an indexing hook component and a hook engagement component. One of these components is carried by the assembly, and the other of the components is positioned adjacent to the index position of the assembly. The hook component is positioned to engage the engagement component as the assembly moves into its index position to accurately locate and maintain the assembly in the index position until the anchor is moved into its down position. When the apparatus also includes the preferred feature of a shock absorber, one of the components is carried by the assembly, and the other component is preferably carried by the shock absorber.

It is within the scope of the invention for the apparatus to have a glue dispenser with a single glue dispensing nozzle and an installation head with a single setting station for installing markers along a single line on a roadway. However, it is preferable that the apparatus be capable of installing markers simultaneously along a double line, as well as being capable of installing a single line of markers. To provide this capability, the glue dispenser preferably has a pair of laterally spaced nozzles and is operable to dispense glue from either of the nozzles or from both of the nozzles simultaneously. The installation head has a pair of laterally spaced setting stations longitudinally aligned with the pair of nozzles.

A preferred feature of the installation head is a slide that is laterally slidable to move markers from a loading station into the setting station or stations. Also preferably, the head includes one or more setting rams, one at each setting station. Each ram is operable to force a marker in its corresponding setting station down onto a deposit of glue dispensed by the glue dispenser onto a roadway. The provision of the setting ram helps ensure that the marker is positively set down into the deposit of glue. In order to further ensure solid adhesive contact between the marker and the deposit of glue, the apparatus may also include a setting wheel mounted on the vehicle rearwardly of the installation head. The wheel is positioned to ride up over a marker that has been forced down onto a deposit of glue by the setting ram.

Apparatus constructed according to the invention allows efficient and accurate installation of road markers on a roadway in an automated setting that allows workers to be isolated from traffic and other hazards. This is accomplished by a combination of apparatus components that are simple in structure but reliable and accurate in operation. The inclusion of a glue dispenser assembly with an anchor helps ensure that a properly configured deposit of glue is accurately positioned to facilitate accurate placement of the markers on the roadway. The use of the sliding assembly and return actuator and a fixed installation head allows the vehicle carrying the apparatus to move continuously along the roadway as the markers are being installed. This further contributes to the efficiency of the operation.

These and other advantages and features will become apparent from the detailed description of the best mode for carrying out the invention that follows.

BRIEF DESCRIPTION OF THE DRAWINGS

In the drawings, like element designations refer to like parts throughout, and:

FIG. 1 is a schematic pictorial view of a trailer portion of a vehicle on which elements of the preferred embodiment of the invention are mounted.

FIGS. 2A, 2B, and 2C are schematic views illustrating three typical patterns in which road markers are laid.

FIG. 4 also illustrates in phantom the return actuator for the assembly.

FIG. 4A is a sectional view of the pneumatic cylinder of the return actuator shown in FIG. 4, with parts shown in elevation.

FIG. 5 shows the assembly returned to its index position and a marker set down onto the deposit of glue by an installation head.

FIG. 8 is a simplified side elevational view of the dispenser assembly and shock absorber with the assembly in its index position.

FIG. 9 is a simplified side elevational view of the assembly with the anchor in its down position.

FIG. 18 is a pictorial view of a first preferred embodiment of the installation head portion of the apparatus, with foreground portions omitted.

FIG. 19 is a pictorial view of the installation head floor and slide shown in FIG. 18, illustrating the setting rams and slide ram schematically.

FIG. 20 is a pictorial view of the preferred embodiment of the floor shown in FIGS. 18 and 19.

FIG. 21 is a plan view of the floor shown in FIG. 20.

FIG. 28 is a sectional view of portions of the preferred embodiment of the installation head shown in FIG. 18, illustrating the setting ram and a modified slide, with parts shown in elevation.

FIG. 29 is a bottom plan view of the setting ram head shown in FIG. 28.

FIG. 30 is a bottom plan view of a setting ram head designed for use with square reflector markers.

FIG. 31 is an elevational view of the ram head shown in FIG. 30 engaging a road marker, shown in phantom.

FIGS. 32–34 are partially schematic pictorial views showing the installation head slide of FIGS. 18 and 19 in association with its currently preferred actuating ram. FIGS. 32–35 illustrate three different positions of the slide corresponding to three modes of operation of the actuating ram.

FIG. 35 is a top plan view of the installation head shown in FIG. 18.

FIG. 40 is a side elevational view of the rear end portion of the mounting rail and associated installation heads and setting wheel.

FIG. 41 is a pictorial view looking toward the forward end of the setting wheel.

FIG. 42 is a pictorial view of a feeding mechanism for feeding stacks of markers into position for the markers to be fed down into an installation head.

FIG. 45 is a pictorial view of hose guide apparatus.

FIG. 46 is a simplified elevational view of the apparatus shown in FIG. 45, illustrating an extended position in broken lines.

FIG. 56 is an elevational view, with parts shown in section, of apparatus for removing old turtles from pavement.

BEST MODE FOR CARRYING OUT THE INVENTION

Figure 3:
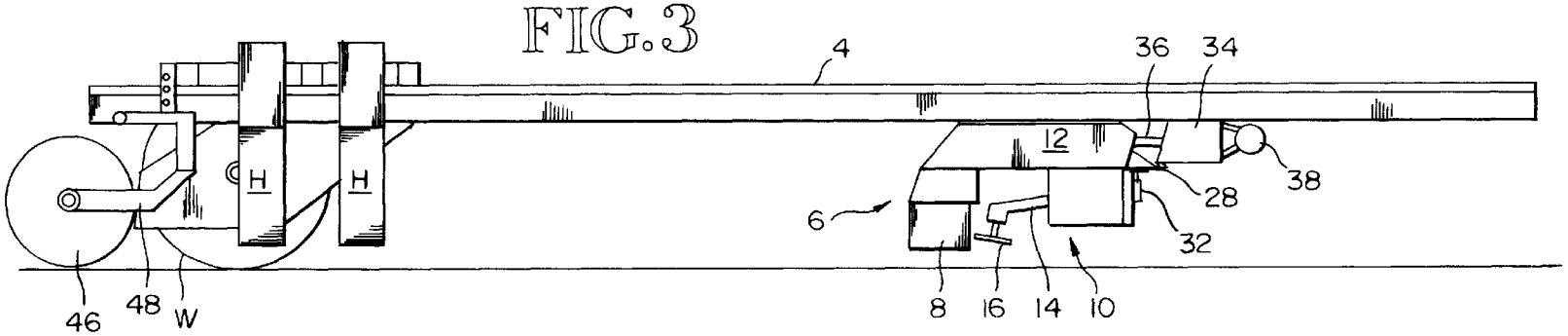
FIG. 3 is a partially schematic side elevational view of the preferred embodiment of the invention showing the glue dispenser assembly in its index position.

The drawings show apparatus for installing raised road markers on a roadway. The illustrated apparatus is constructed according to the invention and also constitutes the best mode for carrying out the invention currently known to the applicant. The apparatus of the invention may include various means for delivering road markers to the installation head H. In a particular use of the apparatus of the invention, the apparatus may include alternate delivery means. However, it is currently anticipated that most individual installations will include only one delivery means. In FIG. 1, the delivery means is shown generically as a carrousel C that delivers markers down through a feed tube 2. The currently preferred delivery means is shown in FIG. 42 and described below.

FIG. 1 shows the trailer portion V of a vehicle having a bed mounted on wheels W to permit the trailer V to be pulled by a cab portion of the vehicle (not shown). Elements of the apparatus of the invention are mounted on and under the trailer bed. These elements include an adhesive reservoir R and a glue tube D. They also include an air compressor P and an electrical unit E for powering the other elements. It is anticipated that the apparatus of the invention will be used to install road markers using a hot melt bitumen adhesive. In such case, the reservoir R would be provided with heating means powered by the electrical unit E to maintain the bitumen adhesive at the correct installation temperature. Additional heat may be supplied to a glue dispenser by use of a hot oil reservoir F, as described below. Alternatively, the apparatus of the invention could be used in connection with a two-part adhesive, such as the adhesive sold under the trademark "EPOXY". The use of both types of adhesives for installing road markers is known in the art.

The apparatus of the invention is designed to permit installation of road markers without stopping the forward movement of the trailer V. To facilitate this procedure, the invention provides a glue dispenser that is movable relative to the trailer V at the same speed as the trailer V but in the opposite direction. The dispenser is connected to the lower end of the glue tube D. At least a portion of the tube is flexible to allow the relative movement. According to the invention, the relative movement is achieved by maintaining the dispenser stationary relative to the pavement on which the road markers are being installed while the adhesive is being dispensed.

The system of the invention is designed for fully automated installation of road markers. The invention makes it possible for two workers to simultaneously lay markers on both sides of a traffic lane at a rate of about five miles per hour. One worker drives the vehicle on which the apparatus of the invention is mounted. The other worker monitors the operation, visually and/or through a video monitor, and provides any command input that may be required, such as a command to begin laying the markers in a particular predefined pattern. Both workers preferably remain in the cab of the vehicle during the laying operation. Laying of markers simultaneously on both sides of the lane is enabled by providing certain elements of the apparatus, such as the installation head H, on both sides of the vehicle V. The execution of the laying operation is computer controlled, with various steps in the operation being triggered by sensors that detect movement of portions of the apparatus and/or the presence or absence of objects. The sensors signal the computer, which then signals the parts of the apparatus to activate or deactivate, as appropriate. At present, the major constraint on the speed of operation is the state of the art of adhesives and adhesive application.

FIGS. 2A, 2B, and 2C show three typical patterns in which raised markers are laid on a roadway. Two different types of markers are illustrated. The first is a round marker T, sometimes referred to as a "turtle". The second is a square reflective marker RM. Both of these types of markers are commonly used to mark lanes on a roadway. FIG. 2A shows a single line of markers in a typical pattern used between two lanes of traffic moving in the same direction. The line of markers includes primarily round markers T with every sixth or seventh marker being a reflective marker RM. FIG. 2B shows a double line of markers commonly used between lanes of traffic moving in opposite directions. The markers in each line are in the same pattern as is shown in FIG. 2A. FIG. 2C shows a modified form of the arrangement shown in FIG. 2B. In this arrangement, one of the lines of markers has gaps in it and includes fewer reflective markers RM.

Figure 44:
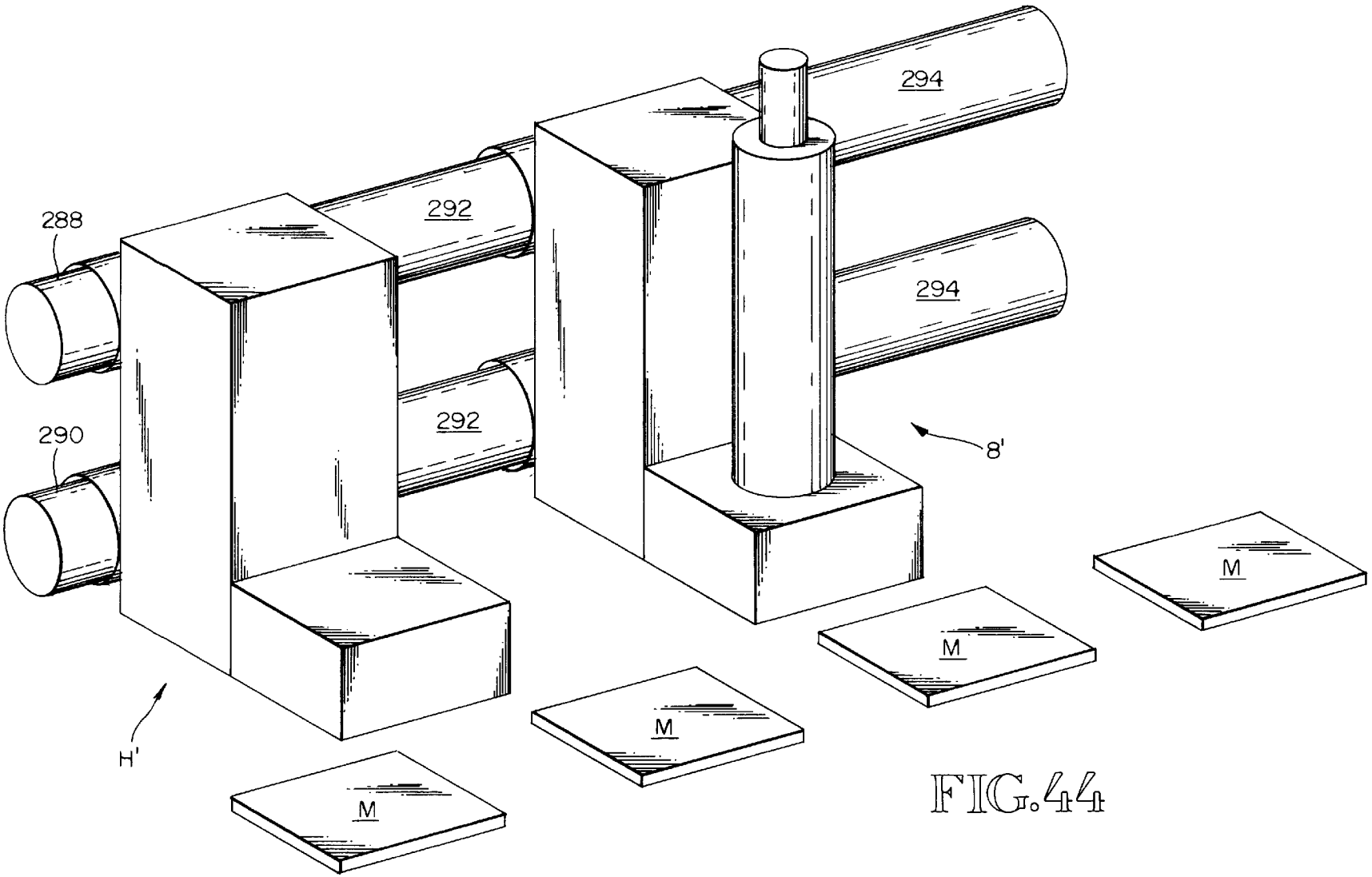
FIG. 44 is a schematic pictorial view of apparatus for laying traffic indicators that extend across a lane.

The apparatus of the invention may be used to lay any one of the marker patterns shown in FIGS. 2A, 2B, or 2C or lines of markers in various other configurations. The apparatus may also be used for providing traffic control indicators that extend across a lane. For example, the markers might be used in a configuration that forms a turn-only arrow or traffic control words, such as "left only". To lay a double line of markers, such as those shown in FIGS. 2B and 2C, an installation head H with two laterally spaced setting stations and a dual nozzle glue dispenser are preferred. These elements are described further below. To lay traffic indicators that extend across a lane, additional apparatus may be carried by the vehicle V or, alternatively, more than one pass may be made along the roadway section being marked. An arrangement of suitable additional apparatus is shown in FIG. 44 and described below.

Figure 4:
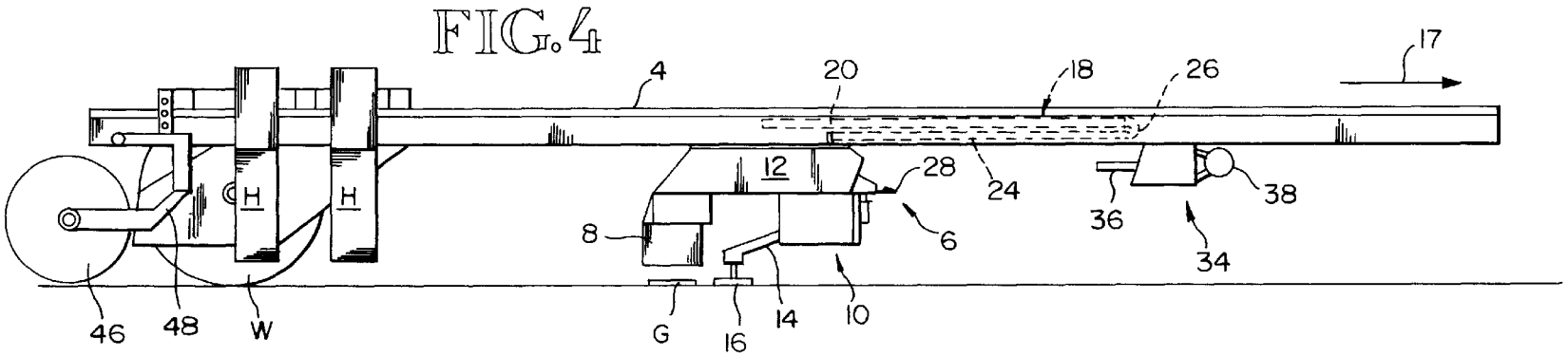
FIG. 4 is like FIG. 3 except that it shows the glue dispenser assembly with the anchor down dispensing a deposit of glue onto a roadway.
Figure 5:
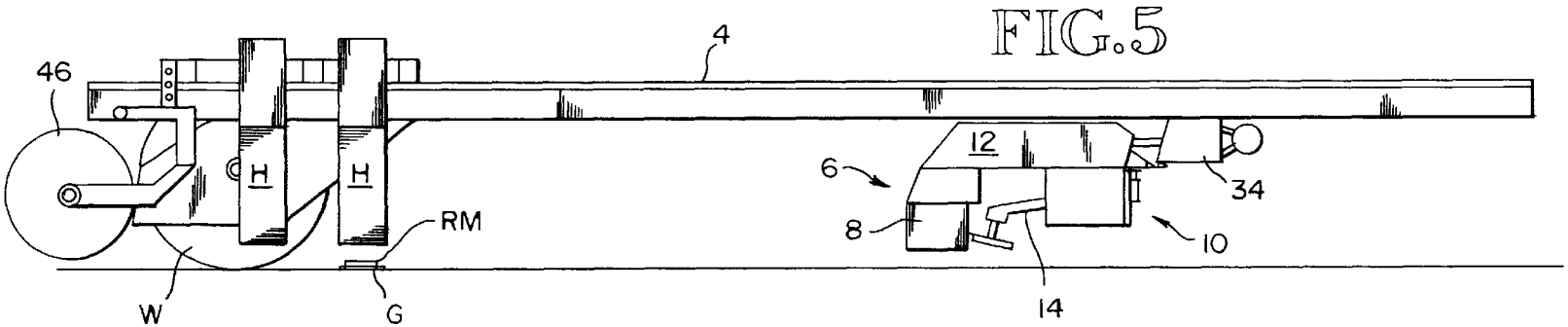
FIG. 5 is like FIG. 3 except that it shows the apparatus during the installation procedure following the dispensing of glue illustrated in FIG. 4.
Figure 6:
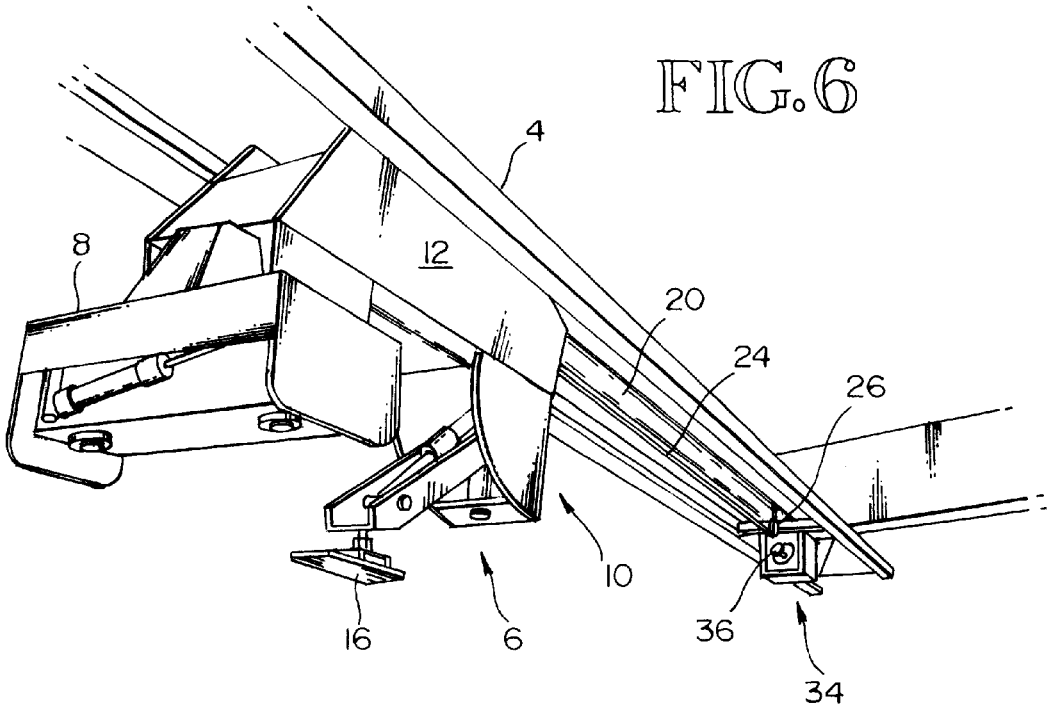
FIG. 6 is a pictorial view looking up at the preferred embodiment of the dispenser assembly and toward the shock absorber for the assembly.

FIGS. 3–5 illustrate the basic arrangement of the elements of the apparatus of the invention. The apparatus includes a mounting rail 4 that is attachable to a vehicle, such as the trailer V shown in FIG. 1. The rail 4 extends longitudinally along a side edge portion of the trailer V. At least one installation head H is mounted on the vehicle in a position fixed relative to the rail 4 and adjacent to a first end portion of the rail 4. The installation head may be mounted in various ways, such as by securing it to the end portion of the rail 4. The provision of a single installation head H is within the scope of the invention. However, there are preferably two installation heads H spaced slightly longitudinally apart, as shown in FIGS. 3–5. This arrangement facilitates the laying of two types of markers in one pass of a vehicle along the line of markers. For example, one installation head H may be provided with round markers T, while the other installation H is provided with square reflective markers RM. For special situations in which more than two types of markers are required, more than two installation heads H could be provided. Whatever the number of installation heads H, each head H has a setting station from which markers are dispensed down onto the roadway.

An important feature of the invention is a glue dispenser assembly 6 that is slidably mounted on the rail 4. The assembly 6 includes a glue dispenser 8 and an anchor subassembly 10. The two components 8, 10 are connected together and slidably mounted on the rail 4 by a housing 12.

The anchor subassembly 10 includes an anchor 14 that is pivotally mounted to move an anchor foot or pad 16 into a down position, shown in FIGS. 4 and 9, in which it prevents movement of the assembly 6 relative to a roadway. In addition to the down position shown in FIGS. 4 and 9, the anchor 14 has an up position, shown in FIGS. 3, 5 and 8, in which the anchor pad 16 is out of engagement with the roadway. When the anchor 14 is in the down position and the vehicle on which the apparatus is mounted continues its forward movement indicated by the arrow 17 in FIG. 4, the glue dispenser assembly 6 remains stationary relative to the roadway and slides rearwardly along the rail 4 from the index position shown in FIGS. 3 and 5 toward the installations heads H.

A return actuator 18 is provided for the assembly 6. The actuator 18 permits the relative rearward movement of the assembly 6 along the rail 4 when the anchor 14 is in its down position. The actuator 18 is operable to positively move the assembly 6 forwardly along the rail 4 to return the assembly to its index position when the anchor 14 is moved out of its down position and into its up position.

Referring to FIGS. 4 and 4A, the return actuator 18 preferably comprises a single acting pneumatic cylinder 20. The cylinder 20 has a pressure chamber 21 that is continuously connected to a source of pressure to continuously bias the assembly 6 toward the index position. A piston head 22 is slidable within the cylinder 20 and defines one end of the pressure chamber 21. The piston head 22 separates the pressure chamber 21 from a vented chamber 23 that is vented to atmosphere. A flexible cable 24 has one end secured to the piston head 22 and extends out through the end of the cylinder 20 and around a pulley 26. The opposite outer end of the cable 24 is secured to the assembly 6. The continuous pressure in the pressure chamber 21 automatically pulls the assembly 6 back into its index position when the anchor 14 is raised into its up position, but allows the assembly 6 to slide along the rail 4 when the anchor 14 is down.

Figure 7:
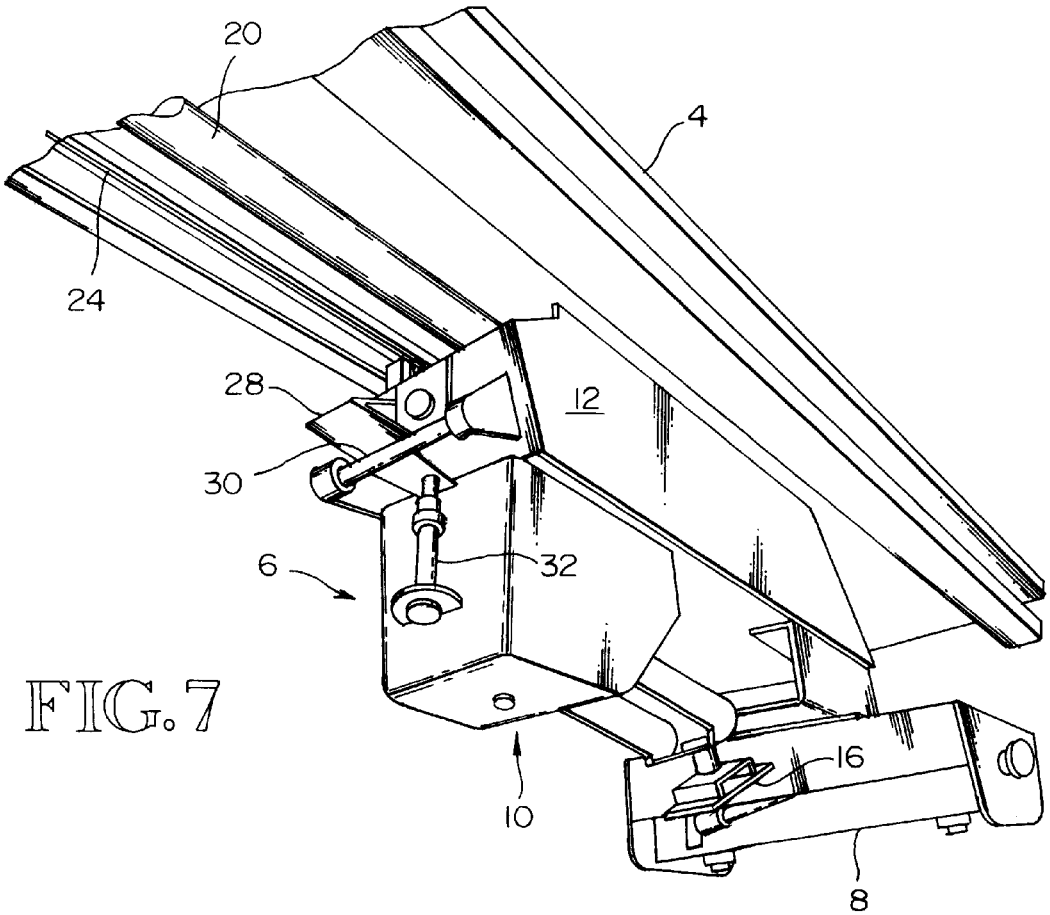
FIG. 7 is a pictorial view looking up toward the forward end of the dispenser assembly shown in FIG. 6.

In order to provide for the accurate positioning of the assembly 6 in its index position and thereby provide for accurate placement of deposits G of glue, the apparatus preferably includes an indexing hook component 28 and a hook engagement component 44. One of these components is carried by the assembly 6, and the other component is positioned adjacent to the index position of the assembly 6. In the illustrated preferred embodiment, the indexing hook 28 is carried by the assembly 6, and the engagement component is in the form of a shoulder 44 on a shock absorber 34, described further below. The hook 28 is pivotally mounted on the forward end of the assembly 6 on a pivot shaft 30, shown in FIGS. 7, 8 and 10. A single acting pneumatic cylinder 32 is operable to pivot the hook 28 into an unhook position. When air pressure is removed from the cylinder 32, a spring return biases the hook into an engagement or hooked position. The hook 28 is positioned to engage the shoulder 44 as the assembly 6 moves into the index position shown in FIGS. 3, 5 and 8 to thereby accurately locate and maintain the assembly in the index position until the anchor 14 is again moved into its down position.

Figures 10, 11:
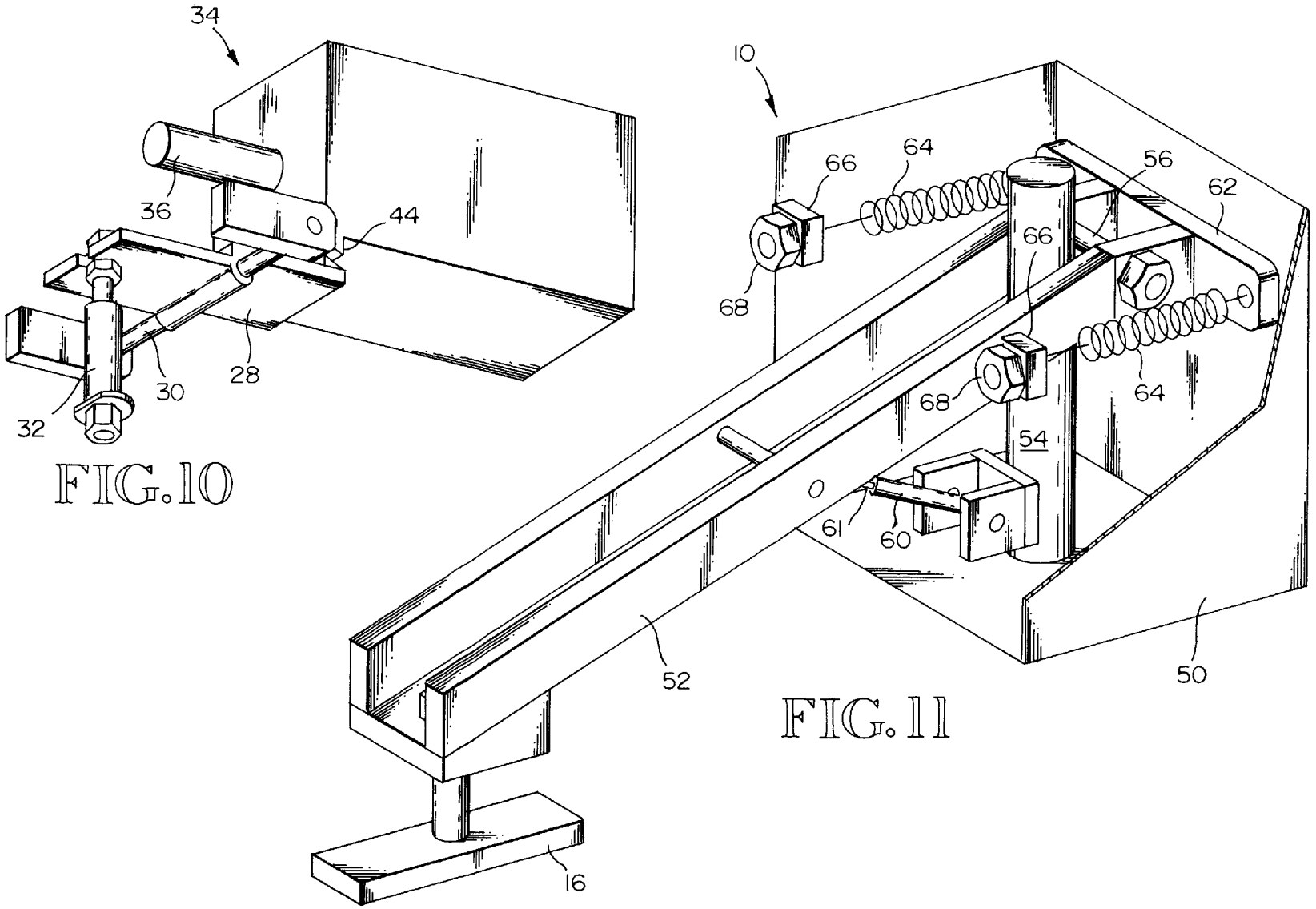
FIG. 10 is a simplified pictorial view of the shock absorber and the indexing hook portion of the assembly.
FIG. 11 is a simplified pictorial view of the anchor portion of the assembly shown with the anchor in its down position and with foreground portions of the assembly housing cut away to reveal the anchor actuating mechanism.

Referring to FIGS. 3–6, 8, and 10, the apparatus includes a shock absorber 34 fixed relative to the rail 4 and positioned to cushion and arrest sliding movement of the assembly 6 as the assembly 6 slides forwardly into the index position. Preferably, the shock absorber 34 is mounted by securing it to the forward end portion of the rail 4, as shown in FIGS. 3–6 and 8. The shock absorber may be of various known types having a piston rod 36 projecting therefrom to engage a moving structure to cushion and arrest movement of the structure. As shown in FIGS. 3–5, and 8, the piston 36 engages the front end of the assembly 6 as the assembly 6 moves into its index position. To permit adjustment of the cushioning force of the shock absorber 34, the shock absorber 34 preferably has an auxiliary pneumatic cylinder 38 mounted on the front end thereof by means of a mounting clamp 40, as best seen in FIG. 8. The cylinder 38 is connected to the main shock absorber cushioning chamber by a hose 42. The connection is adjustable to permit adjustment of the cushioning force. The hook engagement shoulder 44 mentioned above is positioned on the underside of the main housing of the shock absorber 34 at the rear end thereof. The shoulder 44 faces forwardly to engage a rearwardly facing hooking surface of the hook 28, as shown in FIGS. 3, 5, and 8. FIG. 10 illustrates the hook 28 spaced rearwardly of the shoulder 44.

Referring again to FIGS. 3–5, the apparatus of the invention preferably further includes a setting wheel 46 mounted on the vehicle rearwardly of the installation heads H. As shown, the wheel 46 is pivotally mounted on the rail 4 by a pivot mount 48 to permit the wheel 46 to move upwardly as it rides up over a marker. As the wheel 46 rides up over a marker, the weight of the wheel causes the marker to be urged down into a deposit of glue G onto which the marker has been deposited by a setting ram, described below.

Figure 12:
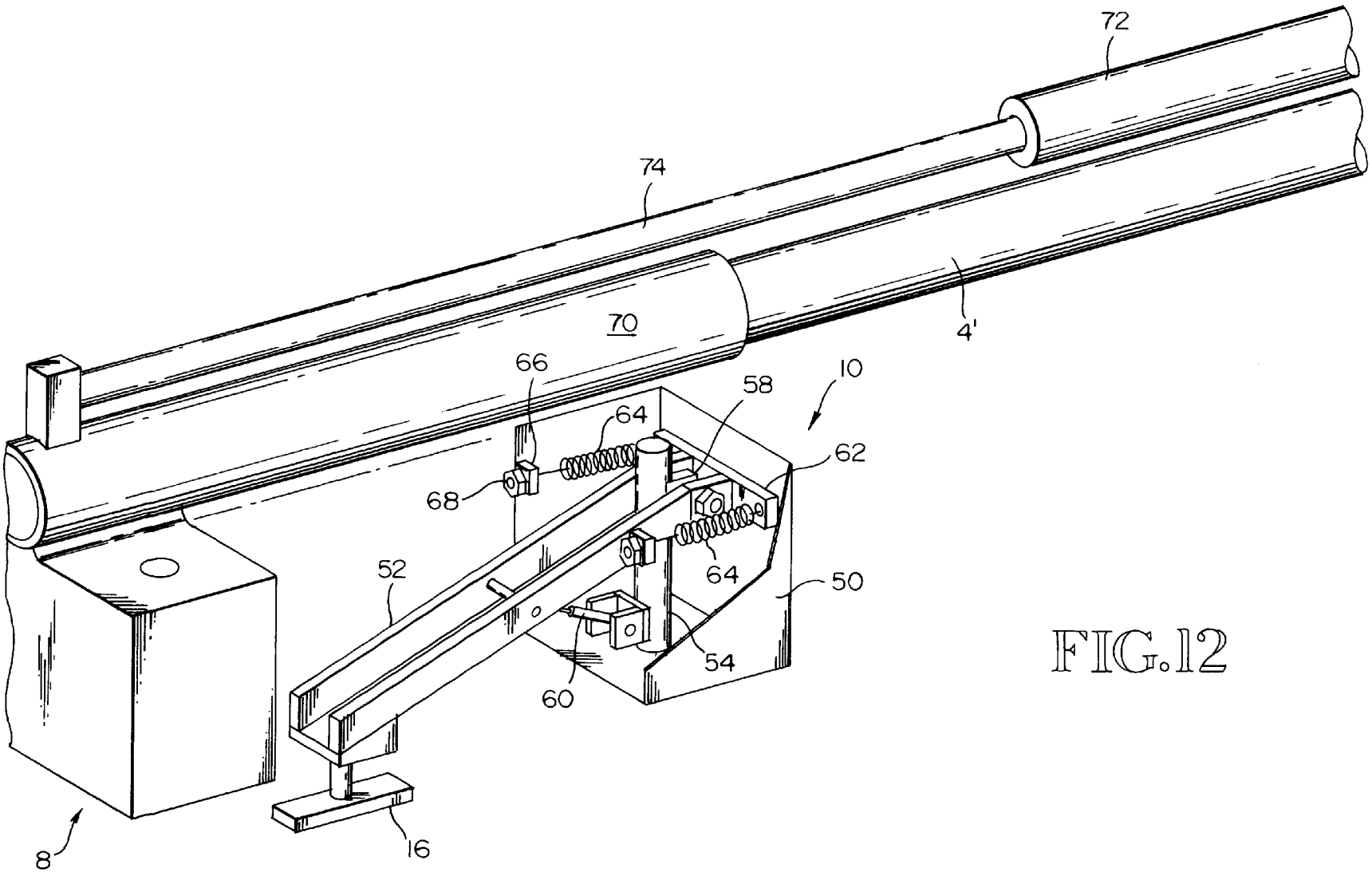
FIG. 12 is a pictorial view showing portions of the assembly and connection of the assembly to a sliding tube to provide a slidable mount for the assembly.

The details of the anchor mechanism are shown in FIGS. 11 and 12. The mechanism is mounted in a housing 50 the top and part of one side of which is omitted in FIGS. 11 and 12 to reveal the mechanism. The anchor pad 16 is mounted on one end of an anchor arm 52. The arm 52 is pivotally mounted on a vertical support 54 by a pivot shaft 56, which can be seen in FIG. 11. The shaft 56 is secured to the support 54 by the connector 58 shown in FIG. 12. The connector 58 allows limited pivotal movement of the shaft 56 about the support 54 to allow lateral movement of the arm 52. Referring especially to FIG. 11, an anchor actuator 60, 61 has a first end pivotally connected to the support 54 and a second end pivotally connected to the anchor arm 52. The end of the actuator connected to the support 54 is one end of a double acting pneumatic cylinder 60. A piston rod 61 extends from the outer free end of the cylinder 60 and has an outer end which is pivotally connected to the arm 52. The rod 61 is extended and retracted to pivot the arm 52 to move the anchor 14 between its up and down positions.

In order to protect the anchor mechanism from damage caused by lateral movement of the vehicle, the mechanism allows lateral movement of the anchor arm 52 relative to its support 54. As described above, the pivotal connection of the pivot shaft 56 to the support 54 allows the relative lateral movement. Resistance to the movement is provided by centering springs 64. The end of the arm 52 opposite the pad 16 is secured to a laterally extending spring mount 62. A coil spring 64 is provided at each of the laterally opposite ends of the mount 62. Each spring 64 has a first end secured to the mount 62 and a second opposite end secured to a rear spring mount 66 formed by a mounting lug projecting laterally inwardly from the adjacent sidewall of the housing 50. A spring adjustment nut 68 is provided at each rear mount 66 to allow adjustment of the spring tension to adjust the resistance of the arm 52 to lateral movement. To further protect the anchor from damage and to permit adjustment of the anchor pad 16 to roadway contours, the pad 16 is pivotally connected to the arm 52 by a universal joint (not shown).

FIG. 12 also shows a modified form of the mounting rail 4' and the return actuator associated therewith. As shown in FIG. 12, the mounting rail 4' is cylindrical. A tubular sleeve 70 surrounds a portion of the rail 4' and is slidable longitudinally along the rail 4'. The glue dispenser assembly 6 is secured to the sleeve 70 by a housing that interconnects the dispenser and anchor subassembly portions of the assembly 6. The portion of the housing connected to the dispenser 8 is shown in FIG. 12. The forward portions of the connecting housing are omitted to facilitate illustration of the anchor mechanism. The sleeve 70 and assembly 6 are moved forwardly along the rail 4' by an anchor actuator 72, 74. The actuator includes a single acting pneumatic cylinder 72 from which a piston rod 74 projects. The cylinder 72 is fixedly secured to the vehicle V either directly or by means of an intervening connector. The piston rod 74 is retracted by the cylinder 72 to move the sleeve 70 and assembly 6 forwardly along the rail 4'. The sleeve 70 and assembly 6 freely move rearwardly when the anchor is in its down position.

The preferred embodiment of the glue dispenser 8 is shown in FIGS. 13–17. Glue dispensers currently in use have a single nozzle and are not adequate for simultaneous dispensing of glue for placement of two side-by-side markers. They also are not designed for dispensing glue in either one of two side-by-side locations. The glue dispenser of the invention can dispense two deposits of glue simultaneously for simultaneous installation of two side-by-side markers. It also can dispense a single deposit of glue for installation of a single marker in either of the side-by-side positions, in accordance with the needs of a particular situation.

Figure 13:
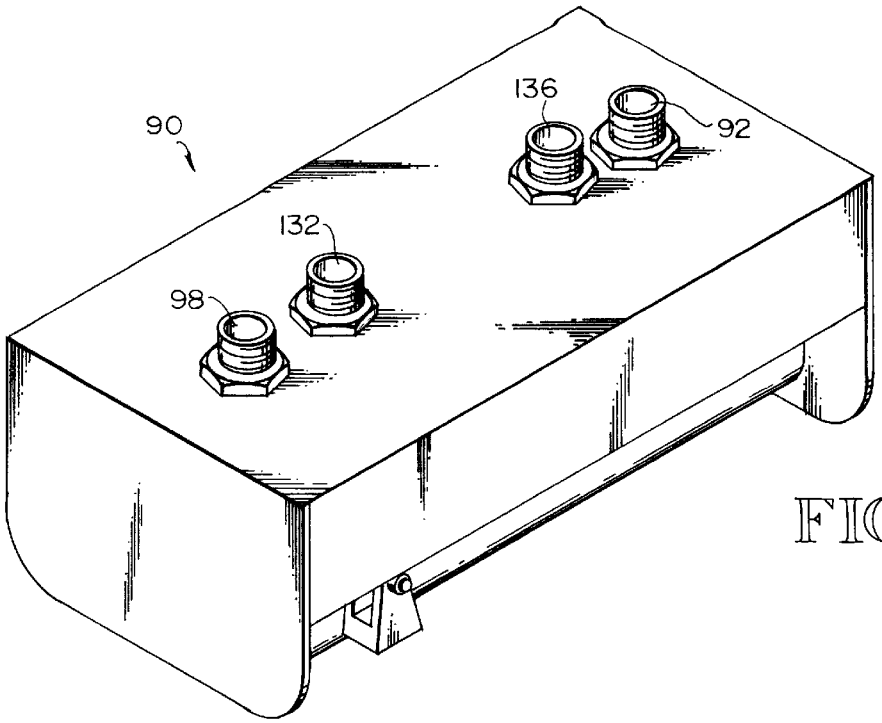
FIG. 13 is a pictorial view looking down at the top of the preferred embodiment of the dispenser portion of the assembly.
Figure 14:
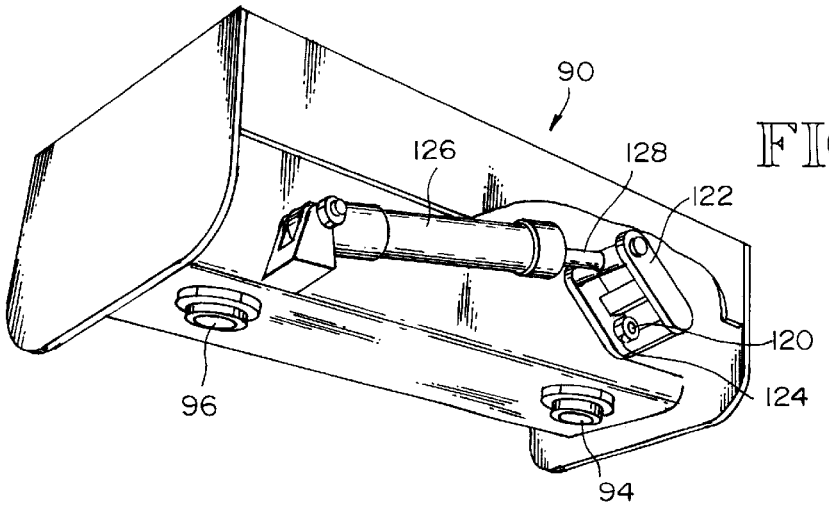
FIG. 14 is a pictorial view looking up at the dispenser shown in FIG. 13, with foreground portions cut away to show the valve actuating mechanism.
Figure 15:
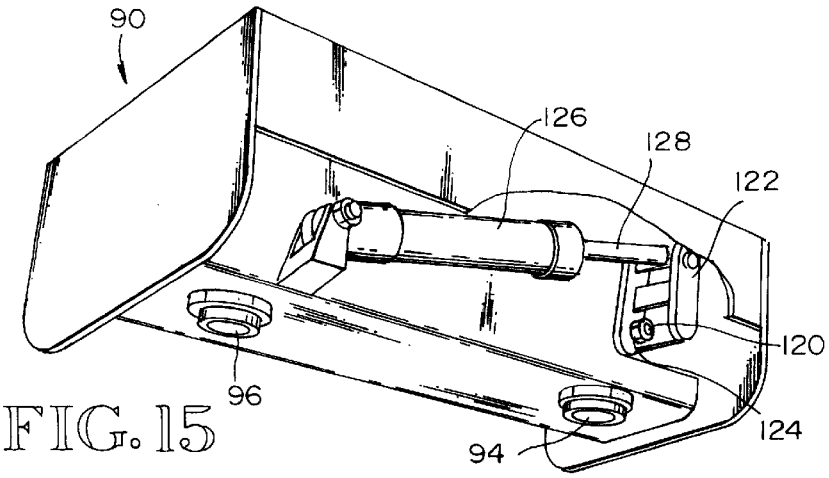
FIG. 15 is like FIG. 14 except that it shows the valve actuating mechanism in a second position.
Figure 16:
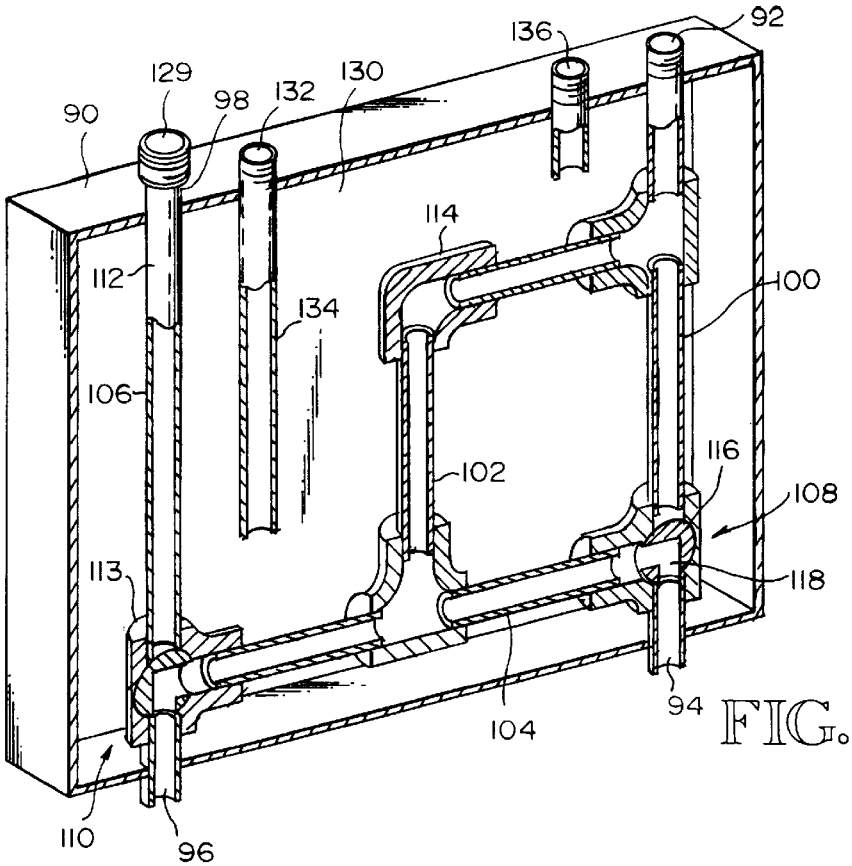
FIG. 16 is a partially schematic sectional view of the preferred embodiment of the glue dispenser showing both valves in a position to dispense glue onto a roadway.
Figure 17:
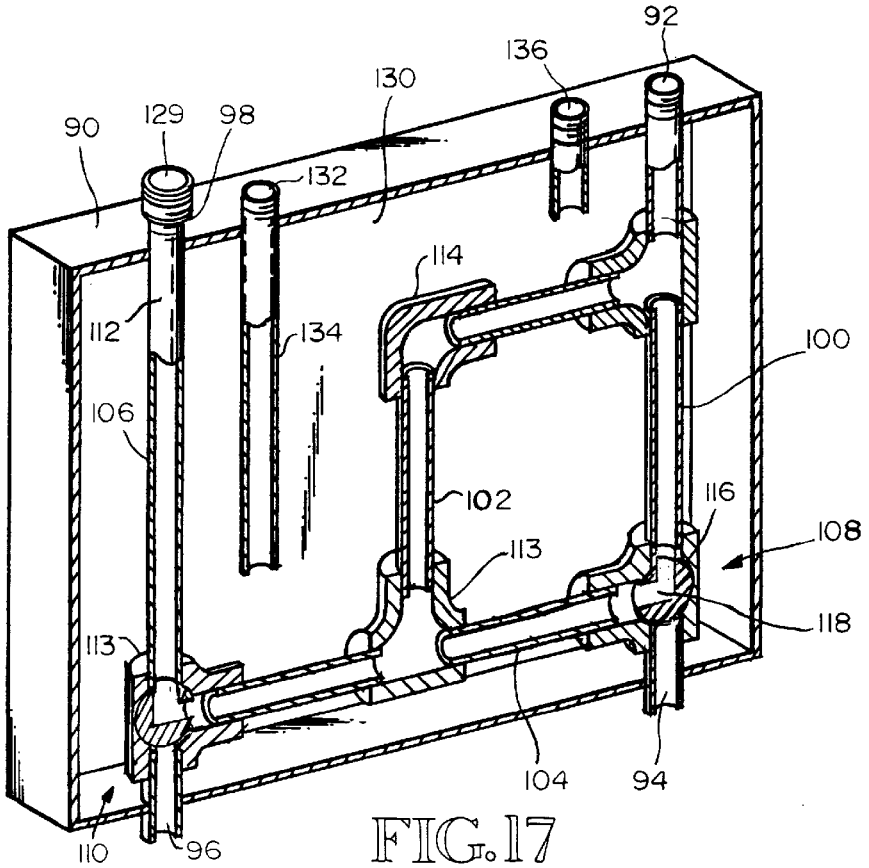
FIG. 17 is like FIG. 16 except that it shows the valves positioned to recirculate glue through the dispenser.

Referring to FIGS. 13–17, the dispenser 8 includes a manifold 90, shown in FIGS. 13–15 and partially schematically in FIGS. 16 and 17. The manifold 90 has a glue inlet 92 and three glue outlets 94, 96, 98 communicating with the inlet 92. Glue is supplied to the inlet 92 through the glue tube D. The first and second outlets 94, 96 are spaced apart a distance equal to the distance that road markers are spaced apart in a typical double line arrangement, such as the arrangements shown in FIGS. 2B and 2C.

Movement of glue through the manifold 92 is directed through a plurality of conduits, as shown in FIGS. 16 and 17. A first conduit 100 extends downwardly from the inlet 92 to the first outlet 94. A second conduit 102 branches off from the first conduit 100 and extends along an L-shaped path horizontally and then downwardly to a lower horizontal conduit 104. A fourth conduit 106 extends vertically between the second and third outlets 96, 98. First and second valves 108, 110 control opening and closing of the first and second outlets 94, 96, respectively. The passageway formed by the third conduit 104 extends between the two valves 108, 110.

The conduits are preferably formed by sections of tubes 112 joined by three-way couplings 113 and two-way coupling 114. The tubes 112 and couplings 113, 114 may be made from various materials. The primary consideration is the ability of the material to maintain its integrity during prolonged exposure to the elevated temperatures required for the glue. In FIGS. 16 and 17, the tubes 112 and couplings 113, 114 are shown generically as being metal. However, it is anticipated that plastic components 112, 113, 114 would generally be preferable to minimize the weight of the apparatus. The preferred construction of tubes and couplings shown in FIGS. 16 and 17 has the advantages of being relatively easy and cost effective to manufacture and maintain.

Referring to FIGS. 16 and 17, each valve 108, 110 includes a ball valve element 116. The element 116 is substantially spherical and has an L-shaped passageway 118 extending therethrough. The element 116 is positioned inside a three-way coupling 113 to provide a two-position, three-way valve. The coupling 113 for the first valve 108 interconnects conduit 100, conduit 104, and a short conduit extending downwardly from the coupling to form the first outlet 94. The valve 108 has a first position in which the passageway 118 in the element 116 communicates conduit passageway 104 with the outlet 94 to thereby direct glue moving into the dispenser through inlet 92 out through outlet 94. This first position is illustrated in FIG. 16. The valve 108 also has a second position illustrated in FIG. 17. In this second position, the valve passageway 118 interconnects conduit 100 with passageway 104 to direct glue from inlet 92 toward the third outlet 98 for recirculation back to the reservoir R.

The second valve 110 similarly has a first glue dispensing position and a second glue recirculating position, shown in FIGS. 16 and 17, respectively. Referring to FIG. 16, the valve passageway 118 communicates the second outlet 96 with the passageway 104 to direct glue from the inlet 92 out through the outlet 96. Referring to FIG. 17, the valve passageway 118 communicates the passageway 104 with conduit 106 to direct glue out through the third outlet 98 for recirculation.

The valve elements 116 are moved between their two positions by means of the actuating mechanism illustrated in FIGS. 14 and 15. A pivot shaft 120 extends from the element 116 out through an external sidewall of the manifold housing to an outer end. A lever 122 is secured to the outer end of the pivot shaft 120. A lock nut 124 prevents relative rotation between the shaft 120 and the lever 122. A pneumatic cylinder 126 pivots the lever 122 between first and second positions, shown in FIGS. 14 and 15, to thereby pivot the element 116 between its first and second positions. A piston rod 128 extends from the cylinder 126 and is pivotally attached to the lever 122. The rod 128 is extendible and retractable to pivot the lever 122.

Glue reservoirs that are commercially available provide line pressure for glue flowing out of the reservoir. Therefore, the glue entering the manifold 90 through the inlet 92 is under some pressure. However, due to the viscous nature of the bituminous adhesive commonly used to secure road markers, the flow pressure of the adhesive provided by the reservoir is not sufficient to cause ejection of the adhesive from an open port. In order to provide increased pressure for proper ejection of the adhesive, the third outlet 98 is provided with a shut-off valve 129, shown schematically in FIGS. 16 and 17. The valve 129 may be of various known types, such as a three-way ball valve. Before the flow control valves 108, 110 are moved into their first positions shown in FIG. 16, the shut-off valve 129 is closed to interrupt flow of glue out of the manifold 90 through the third outlet 98 and back to the reservoir R. Closing the valve 129 creates line pressure in the dispenser conduits 100, 102, 104, 106. The line pressure forces the adhesive out from the ports 94, 96 when the valves 108, 110 are opened. The result is quick ejection of adhesive in sufficient volume to secure a road marker to the roadway. Once the adhesive has been ejected, the shut-off valve 129 is opened to permit recirculation of the adhesive for the purpose described below.

The dispenser 8 preferably includes means for maintaining glue in the manifold within a predetermined range of elevated temperatures. This predetermined range is based on the characteristics of the type of glue being used. The range is the range at which the glue is at a suitable viscosity for dispensing out through the manifold to form a deposit on a roadway that will secure a road marker to the roadway.

In the operation of the dispenser in an automated road marker installation system, such as that shown in FIG. 1, glue is provided to the dispenser manifold from a glue reservoir R down through a glue tube D. Commercially available glue reservoirs have heating mechanisms for maintaining the glue within its operating range. The currently preferred type of reservoir or "glue pot" for use with the dispenser of the invention is a Super Shot 60 (trademark) or a Super Shot 250 (trademark) sold by Crafco, Inc., Chandler, Ariz. These two glue pots are of a type having an adjustable gear drive motor to feed glue under pressure into a glue tube. The amount of feed pressure can be adjusting by adjusting the motor. The glue pot maintains the glue in the reservoir at an operating temperature. However, glue in the glue tube D and in the manifold of the apparatus of the invention can cool below the operating range unless additional means is provided for maintaining it within the range.

In the preferred embodiment shown in FIGS. 13–17, the manifold housing defines an internal cavity 130 surrounding the conduits 100, 102, 104, 106 through which glue moves in and out of the manifold 90. The manifold 90 has a hot fluid inlet 132 and a hot fluid outlet 136, both of which communicate with the internal cavity 130. The fluid inlet 132 and fluid outlet 136, in use, are connected to a hot fluid source remote from the manifold 90. Preferably, the inlet 132 and outlet 136 are connected to a hot oil reservoir F. This provides a source of heat to maintain glue in the conduits 100, 102, 104, 106 within the predetermined range of elevated temperatures.

As can be seen in FIGS. 16 and 17, the oil inlet 132 communicates with the cavity 130 via an inlet tube 134 that extends downwardly into the cavity 130 for a distance about 60% of the vertical height of the cavity 130. The tube connected to and forming the oil outlet 136 is much shorter. The elongated inlet tube 134 for the inlet 132 helps ensure that the temperature of the hot oil circulating through the cavity 130 is substantially constant throughout all portions of the cavity 130. The oil is circulated by a suitable pump down from the hot oil reservoir F into the manifold through the inlet 132 around and through the cavity 130 and out the outlet 136 back to the reservoir F. The reservoir F is provided with a conventional heater and thermostat to maintain it at a desired temperature. In the preferred embodiment, the reservoir F is part of the glue pot heating system, for example, the heating system of a Crafco Super Shot 60 (trademark) glue pot.

The circulating of hot oil through the internal cavity 130 and the recirculating of undispensed glue from the manifold 90 back to the glue reservoir R both contribute toward the accurate maintenance of the temperature of the glue in the manifold within its predetermined operating temperature range. The maintenance of the operating temperature helps ensure that the functioning of the first and second glue outlets 94, 96 as dispenser nozzles is maintained. The maintenance of the desired temperature prevents the outlet nozzles 94, 96 from becoming clogged and, in effect, causes the nozzles 94, 96 to be self-cleaning.

FIG. 18 shows a first embodiment of the installation head H in more detail. The head H may be used in connection with an entirely vertical feed tube 2, as shown in FIG. 1, or with a modified feed tube having an upper angled section (not shown). The angled section allows the head H to be laterally offset from the trailer bed. Whatever the configuration of the feed tube, road markers are fed downwardly through the vertical tube 2 into a vertical loading chamber 140. The markers may be of various types, such as the round markers T and square reflective markers RM shown in FIGS. 2A–2C. The chamber 140 is defined by a laterally outer (relative to trailer V) wall 142, a laterally inner wall 144 and opposite laterally extending sidewalls 146. A fitting is provided at the top of the chamber 140 to receive the lower end of the feed tube 2. The fitting 148 shown in FIG. 18 is circular to receive a cylindrical feed tube for round markers T. A square fitting for a square feed tube could also be provided. Such a tube can accommodate either round or square markers.

In accordance with the invention, the installation head has one or more setting stations and preferably has two setting stations longitudinally aligned with the first and second outlet nozzles 94, 96 of the dispenser 8. In FIG. 18, the foreground sidewall is omitted to show the portions of the installation head H positioned between the sidewalls 146. The laterally inward direction is indicated in FIG. 18 by the arrow 150. The markers T are moved laterally inwardly and outwardly within the head H by a slide 152 and ultimately to one of two setting stations 154, 156, from which they are set down upon the pavement, as described further below.

Still referring to FIG. 18, the head H has two loading stations. The first loading station is defined by the loading chamber walls 142, 144, 146 and is located at the bottom of the loading chamber 140. The second loading station 158 is defined by a vertical opening in the slide 152. The slide 152 is slidably mounted on a horizontal installation head floor 160. Thus, the location of the second loading station 158 is movable. The slide 152 is preferably moved horizontally back and forth along the upper surface of the floor 160 by a ram. FIG. 19 schematically shows a ram 162 positioned endwise of the floor 160 to engage the laterally inner end of the floor. The bottoms of the loading chamber walls 142, 144 are spaced above the floor 160 a distance slightly greater than the height of the markers to allow markers to move along the floor 160, one at a time, under the walls 142, 144, into and out from the loading station at the bottom of the loading chamber 140. The height (vertical thickness) of the slide 152 is substantially equal to the height of the markers to allow the slide 152 to slide under the walls 142, 144.

FIGS. 20 and 21 show the details of the structure of the floor 160. The floor 160 has a main slotted portion 164 with intersecting longitudinal slots 166 and cross slots 168. The slots 166, 168 provide holes through the slotted portion 164 at their intersections. This helps to prevent accumulation of debris on the floor 160 to thereby maintain smooth sliding engagement between the slide 152 and the floor 160. The floor 160 also includes a square portion 170 separated from the slotted portion 164 by a vertical opening that defines the first setting station 154. The square portion 170 preferably has the same slotted configuration as the main portion 164.

A setting ram 172, shown in FIG. 19, is provided at each of the setting stations 154, 156. Referring to FIG. 18, a horizontal mounting wall 174 extends from the outer end of the installation head H to the outer wall 142 of the loading chamber 140, between the sidewalls 146 and above the floor 160. An opening 176 extends vertically through the mounting wall 174 above each of the setting stations 154, 156. The openings 176 are sized to permit the corresponding rams 172 to move downwardly and upwardly through the wall 174 during a setting procedure. Each ram 172 has a housing (not shown in FIG. 19) that is secured to the wall 174. At each setting station 154, 156 there is also provided a pair of opposite bomb bay doors 178. In FIG. 18, the door mounted on the omitted foreground sidewall is not shown. The manner in which the doors 178 function is described further below. A stop, such as an end wall, is preferably provided to limit lateral movement of a marker entering setting station 156 and maintain the marker in alignment with the ram 172.

Road markers that are delivered to the bottom of the loading chamber 140 down through the feed tube 2 are moved laterally within the head H by the slide 152. As noted above, the markers are moved laterally to the setting stations 154, 156 from which they are set down onto the pavement by the setting rams 172. When a marker is delivered to one of the setting stations 154, 156, it is maintained at a vertical level flush with the top of the floor 160 by the bomb bay doors 178. The bomb bay doors 178 support the marker until the setting ram 172 is activated to force the marker down through the bomb bay doors 178 and onto the pavement.

FIGS. 22–26 show the preferred configuration of the bomb bay doors 178 and illustrate the function of the doors 178. Each setting station 154, 156 is provided with a pair of bomb bay doors 178 mounted on the opposite sidewalls 146 of the head H. Each door 178 has an L-shaped configuration with a generally vertical leg 180, a generally horizontal leg 182, and a cylindrical end portion 184 at the free end of the horizontal leg 182. The upper free end of the vertical leg 180 is connected to a hinge 186 that is mounted on the outer face of the respective sidewall 146 by means of a hinge plate 188. A biasing spring 190 is mounted on a post 192 that has an inner end secured to the sidewall 146, extends outwardly through a hole in the vertical leg 180, and terminates in an outer abutment 194 formed by an end cap. The opposite ends of the spring 190 abut against the outer abutment 194 and the vertical leg 180, respectively. The horizontal leg 182 extends from the bottom edge of the vertical leg 180 through an opening 196 in the sidewall 146. The spring 190 biases the door 178 into the position shown in FIGS. 22 and 24.

Figure 22:
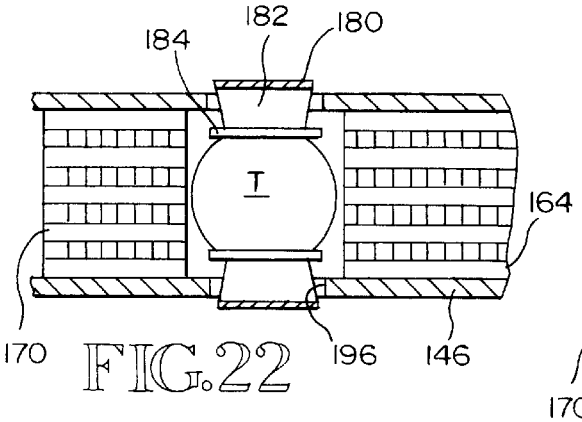
FIG. 22 is a fragmentary bottom plan view of a portion of the installation head floor shown in FIGS. 18–21 illustrating a road marker supported by the bomb bay doors ready to be set down onto pavement by the setting ram.
Figure 23:
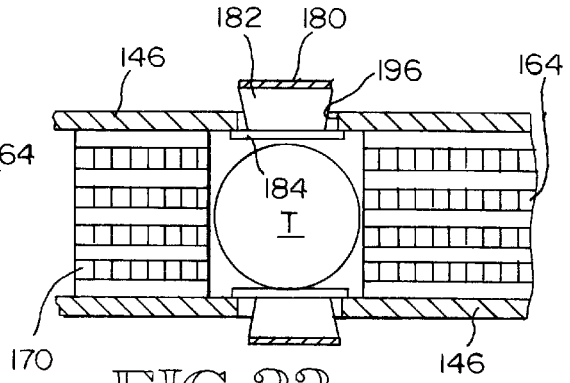
FIG. 23 is like FIG. 22 except that it shows the marker as it is being moved downwardly and is forcing the bomb bay doors open.
Figure 24:
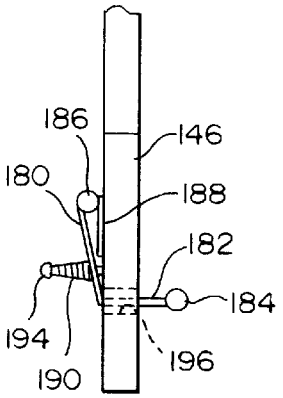
FIG. 24 is a fragmentary side elevational view of one of the installation head sidewalls and a bomb bay door mounted thereon, showing the bomb bay door in the position shown in FIG. 22.
Figure 25:
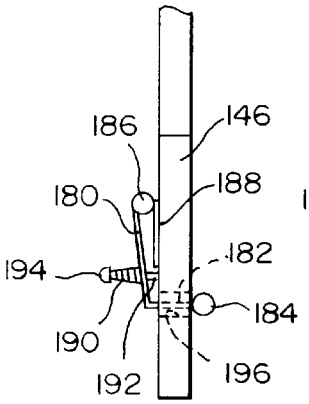
FIG. 25 is like FIG. 24 except that it shows the bomb bay door in the open position shown in FIG. 23.
Figure 26:
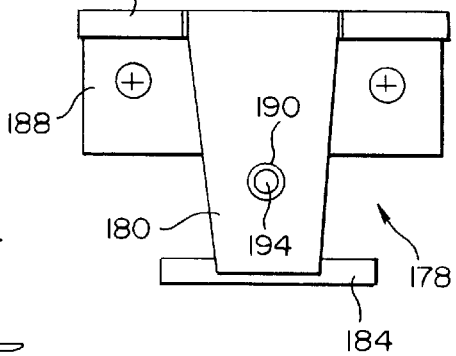
FIG. 26 is an elevational view of the preferred embodiment of the bomb bay door shown in FIGS. 22–25.

When both doors 178 at the station 154, 156 are in the position shown in FIGS. 22 and 24, the upper surfaces of the cylindrical end portions 184 are flush with the top of the floor 160 and support a marker T in the station 154, 156, as shown in FIG. 22. Since the tops of the door portions 184 and the floor 160 are flush, the marker T may either be moved from the first station 154 to the square portion 170 of the floor 160 by the slide 152 or set down onto the pavement at station 154 by the setting ram 172. A marker at the second station 156 has reached the limit of its travel and is set down onto the pavement. At each station 154, 156, when the setting ram 172 is activated, it exerts a downward force on the marker T that pushes the marker T downwardly and forces the horizontal legs 182 of the bomb bay doors 178 outwardly, as illustrated in FIGS. 23 and 25. Once the marker T has cleared the bomb bay doors 178, the springs 190 return the doors 178 to their rest position shown in FIGS. 22 and 24. The doors 178 are then ready to support the next marker that is moved into the station 154, 156 by the slide 152.

Figure 27:
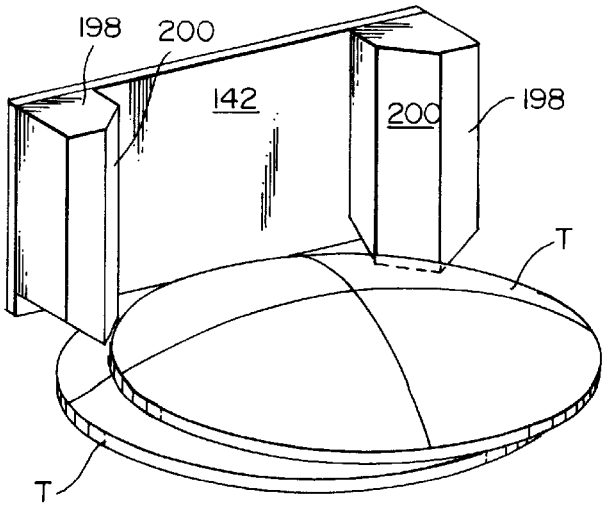
FIG. 27 is a pictorial view of blocking members that may be used in the loading chamber of the installation head shown in FIG. 18.

FIG. 27 illustrates a preferred feature that helps prevent jamming of the installation head H when conventional round markers T are being installed. Referring to FIG. 27, the bottom portion of loading chamber wall 142 may be provided with opposite blocking members 198. Each blocking member 198 has a vertical surface secured to the wall 142. The bottom of the member 198 is spaced a small amount above the bottom of the wall 142. The cross section of the member 198 is in the shape of a square with one corner cut off to form a diagonal vertical surface 200. The diagonal surfaces 200 of the two members 198 are oriented at 90° with respect to each other and 45° with respect to the wall 142. As illustrated in FIG. 27, the height and orientation of the surfaces 200 are such that the surfaces 200 engage a marker T and block its movement when another marker T under the first marker T is pushed out of the loading chamber 140 under the wall 142 by the slide 152. The members 198 prevent the upper marker T from traveling along with the lower marker T and jamming the space under the wall 142. The opposite loading chamber wall 144 may also be provided with a pair of blocking members 198.

FIGS. 28–29 show a modified form of the slide 152' and a ram head 202 for use with round markers T. The slide 152' cooperates with a stop member 204 to hold a marker T in position in alignment with the ram 172 at a setting station 154, 156. The engagement of the marker T prevents the marker T from wobbling. Referring to FIG. 28, the slide 152' has an extension 206 that terminates in a vertical arcuate end surface 208. The stop member 204 is a horizontally oriented U-shaped member having an opening extending vertically through and along the member 204 from an inner arcuate end to an outer open end 210. The opening has a lower portion 212 with a vertical sidewall, a beveled portion 214 with a radially inwardly sloping sidewall, and an upper portion 216 with a vertical sidewall. The opening is dimensioned to receive the extension 206 of the slide 152'.

When the slide 152' is moved toward the member 204, a marker T is engaged by the arcuate surface 208 and is pushed by the slide 152' into the opening in the member 204. The extension 206 of the slide 152' moves with the marker T into the opening and into the position shown in FIG. 28. In this position, the arcuate surface 208 is urged against the marker T to firmly position the marker T with its lower edge in the lower portion 212 of the opening. The beveled surface 214 engages the rounded sloping upper surface of the marker T. The engagement of the marker T by the arcuate surface 208 and opening sidewalls 212, 214 holds the marker T in a horizontal position aligned with the setting ram 172 to prevent wobbling or tilting of the marker T. The radius of curvature of the arcuate surface 208 may be slightly smaller (about ¼ inch) than the radius of curvature of the marker T to ensure firm contact at the two opposite ends of the surface 208. When the marker T has been engaged, the ram 172 may be operated to set the marker T down onto the pavement.

As shown, the slide 152' is configured for use in an installation head having a single setting station. The slide 152' could be modified to include a second loading station, such as the second station 158 shown in FIG. 18. If this were done, appropriate adjustments in the dimensions of the slide 152' and of the installation head floor would need to be made.

FIGS. 28 and 29 illustrate a ram head 202 designed for use with round turtle markers T. As shown in FIG. 28, the ram 172 has a cylinder housing 218 secured to the mounting wall 174 by a nut 220. A piston rod 222 slidably extends out through the lower end of the cylinder housing 218 through the corresponding opening 176 in the mounting wall 174. The ram head 202 is attached to the outer end of the piston rod 222 by a nut 224. The head 202 has a generally cylindrical or disk-like configuration with a downwardly facing recess 226,228. The inner portion 226 of the recess has a cylindrical sidewall. The outer portion 228 of the recess has a beveled sidewall that tapers radially outwardly and downwardly from the bottom edge of the inner portion sidewall. The beveling of the outer recess portion 228 is configured to engage the rounded upper surface of a turtle T. When the ram 172 is activated, the piston rod 222 moves downwardly to move the head 202 downwardly against the turtle T engaged in the stop member 204 by the slide 152'. The force of the head 202 against the turtle T forces the turtle T downwardly and the bomb bay doors 178 outwardly to allow downward passage of the turtle T. The ram 172 forces the turtle T down onto a pool of adhesive dispensed from the glue dispenser 8 with sufficient force to set the turtle T into the adhesive. The diameter of the head 202 is chosen to permit the head 202 to move between the bomb bay doors 178 even when the doors 178 are in their closed position shown in FIGS. 22 and 24.

The ram head 202 shown in FIGS. 28 and 29 is suitable for use with the type of round domed markers known as turtles T. For other types of road markers, other ram head configurations may be used. A ram head 230 suitable for use with a square reflective marker RM is shown in FIGS. 30 and 31. This ram head 230 has a rectangular configuration with a downwardly opening slot 232, 234 extending laterally therethrough. The inner portion 232 of the slot has vertical sidewalls and the outer portion 234 has beveled sidewalls sloping downwardly and outwardly from the bottom of the inner portion 232. A cylindrical recess 236 is provided in the downwardly facing wall of the slot 232,234 for receiving a nut to mount the ram head 230 on a piston rod. The beveled portion 234 of the slot is configured to engage the sloping major side surfaces of a reflective marker RM, as illustrated in FIG. 31.

FIGS. 32–35 illustrate a form of the slide ram 162, shown generically in FIG. 19, that is currently preferred for use with the slide 152 shown in FIGS. 18 and 19. The ram 162 includes a large cylinder 238 having a piston rod 240 projecting therefrom. The outer end of the rod 240 is secured to an end wall 242 of the installation head H. This fixes the rod 240 relative to the head H. The upper surface of a connecting wall 244 is secured to the underside of the cylinder 238. A smaller cylinder 246 is secured to the lower surface of the wall 244. A piston rod 248 extends from the smaller cylinder 246. The outer end of the rod 248 is secured to the laterally inner end of the slide 152. Each of the cylinders 238, 246 is operable to extend and retract its piston rod 240, 248, respectively, relative to itself to thereby move the slide 152 laterally outwardly and inwardly.

A typical marker, such as a turtle T, has a diameter of about 4 inches. The second loading station 158 defined by the slide 152 has a corresponding dimension of four inches as do the two solid portions of the slide 152 on the opposite sides of the loading station 158. The large cylinder 238 has a maximum extension of 8 inches, and the small cylinder 246 has a maximum extension of 4 inches. This permits the slide 152 to be moved laterally outwardly from its laterally inward position shown in FIG. 32 four inches, eight inches, or twelve inches, as required. These travel distances are achieved, respectively, by operating the small cylinder 246 only, by operating the large cylinder 238 only, and by operating both cylinders 238, 246. This allows precise positioning of a marker T in either of the two setting stations 154, 156 without any concern for overtravel of the slide 152.

FIGS. 32–34 also illustrate an additional preferred feature of the slide 152. The laterally outer end of the slide 152 has two spaced side arms 249 projecting laterally outwardly therefrom. These side arms 249 and the adjacent solid portion of the slide 152 together define an open shoe having an open laterally outer end that permits the slide 152 to be retracted laterally inwardly without carrying therewith a marker in the outer setting station 156. The side arms 249 slide along slots in the opposite sidewalls 146 of the installation head H. The arms 249 are spaced a distance of four inches to closely surround a marker received in the shoe and maintain the marker in a correct centered position in each setting station 154, 156. This maintains the marker in a centered position for accurate installation by the setting ram 172. The arms 249 are preferably slightly longer than four inches to ensure their proper functioning.

FIGS. 36–39 illustrate the operation of the first embodiment of the installation head slide 152 for moving road markers into position to be set down onto the pavement by the setting rams. As shown in FIGS. 36–39, square road markers RM are being fed into the installation head down through the loading chamber 140. For purposes of illustration, the sidewalls of the installation head H are omitted and the walls 142, 144, of the loading chamber 140 are shown with a shortened vertical height. A stack of markers RM are shown in the loading chamber 140. In actual operation, it is preferable to maintain the loading chamber 140 full with a stack of road markers. The weight of the road markers helps to maintain the markers at the bottom of the stack properly oriented and to prevent tilting of the markers.

Figure 36:
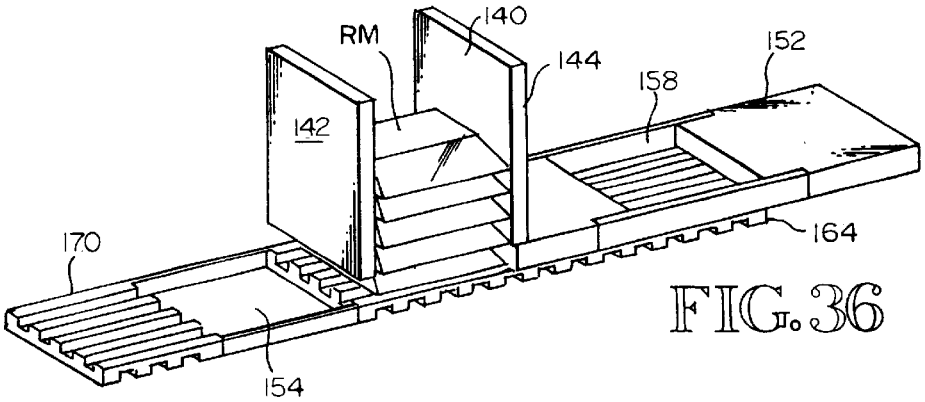
FIGS. 36–39 are pictorial views of the installation head floor and slide and portions of the loading chamber walls shown in FIG. 18, illustrating operation of the slide to move markers into position to be set down onto pavement.

FIG. 36 illustrates the beginning of an operation in which road markers RM in the loading chamber 140 are moved into position for setting down onto pavement. In FIG. 36, the slide 152 is in its fully retracted laterally inner position, i.e. in its extreme rightward (as shown) position. The slide 152 is moved back and forth along the floor of the installation head in increments, with each increment substantially equaling the distance between the two loading chambers walls 142, 144. This distance is also the width of the loading station 158, the solid slide portions on either side of the station 158, floor portion 170, and setting stations 154, 156. As discussed above in connection with FIGS. 32–35, each increment is typically 4 inches.

Figure 37:
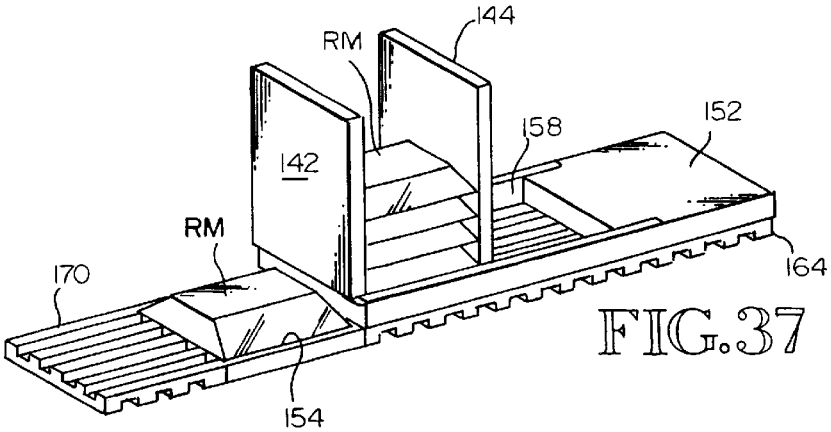

FIG. 37 shows the slide 152 after it has been moved one increment to the left. The movement of the slide 152 has caused the left end of the slide 152 to push the lowermost marker RM in the loading chamber 140 out from the loading chamber 140 and the first loading station and into setting station 154. At setting station 154, the marker RM is supported by the bomb bay doors (not shown in FIGS. 36–39). The second loading station 158 has moved to a position adjacent to the loading chamber 140 but still does not have a marker positioned therein.

Figure 38:
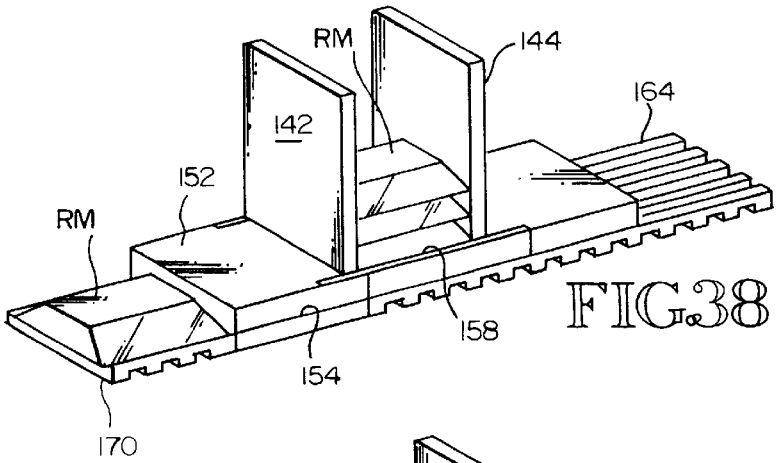
Figure 39:
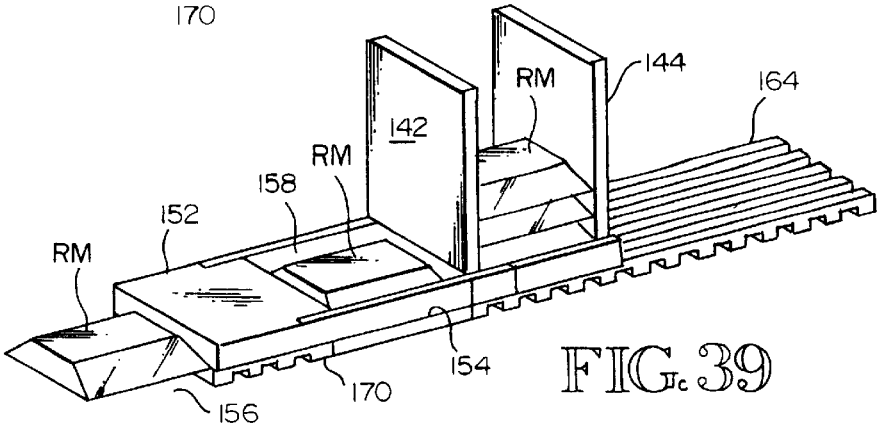

In FIG. 38, the slide 152 has been moved an additional increment from the position shown in FIG. 37. This movement has caused the marker RM at setting station 154 to be moved out of setting station 154 by the end of the slide 152 and onto the square portion 170 of the floor. The second loading station 158 has been moved into the loading chamber 140. In this position, the two loading stations of the installation head coincide. No further markers RM have been moved out of the loading chamber 140 by the second increment of movement of the slide 152 since such movement was blocked by the chamber wall 142. When the loading station 158 moves into registry with the loading chamber, a second marker RM drops down into the loading station 158. This allows the second marker RM to move out of the loading chamber 140 when the slide 152 is moved a further increment to the left into the position shown in FIG. 39. As shown in FIG. 39, the second marker RM has been carried by the slide 152 out of the loading chamber 140 and into setting station 154. At this point in the operation of the slide 152, the second loading station 158 coincides with the setting station 154. Movement of the slide 152 has also moved the first marker RM from the floor portion 170 into the second setting station 156.

At the stage of operation shown in FIG. 39, markers RM are positioned to be set down onto the pavement from one or both of the setting stations 154, 156. After the desired marker or markers RM have been set down, the slide 152 is retracted back into the position shown in FIG. 36. The apparatus then has the configuration shown in FIG. 36 except that there is a new marker RM in the second loading station 158. When the marker RM shown in setting station 154 in FIG. 39 has been set down onto the pavement, the new marker RM drops down into the second loading station 158 when the slide 152 returns to the position shown in FIG. 38 and then is moved out of the loading chamber 140 by the slide 152. If the marker RM at station 154 has not been set down, it is simply carried back by the slide 152 through the loading chamber 140 and then to the right of the loading chamber 140.

When the cycle is again initiated to move markers into the setting stations 154, 156, the presence of a marker RM in the loading station 158 at the beginning of the cycle has no effect on the operation other than to prevent the movement of an additional marker RM into loading station 158 and out from the loading chamber 140 when the slide 152 moves from the position shown in FIG. 37 to the position shown in FIG. 39. The movement of a marker RM through the loading chamber 140 either to the left or to the right is allowed since the space between the bottom of the loading chamber walls 142, 144 and the floor is substantially equal to the vertical thickness of the slide 152 and of the markers RM. As a marker RM slides through the loading chamber 140, it simply serves as a support for the markers RM already positioned in the loading chamber 140, in the same manner that the solid portions of the slide 152 serve as such a support.

Still referring to FIGS. 36–39, the cycle of operation shown therein may be followed repeatedly as long as, at the end of each cycle, both markers in setting stations 154, 156, or only the marker in the second setting station 156, are set down onto the pavement by the setting rams. If the marker in setting station 154 is not set down, it remains in loading station 158 and is carried back by the slide 152 when the slide 152 retracts. However, if the marker in the second setting station 156 is not set down, it is not carried back by the slide 152 and remains in setting station 156. If the cycle shown in FIGS. 36–39 is repeated, a second marker will be moved toward and into the already occupied setting station 156. Although the movement of the second marker may push the first marker in the station 156 against the bomb bay doors 178 to open the doors 178 and therefore discard the first marker, it is preferable not to rely upon this occurrence. In order to maximize the reliability of the apparatus and minimize the chances of jamming the apparatus, it is desirable to prevent a second marker from moving into the setting station 156. The preferred slide ram arrangement shown in FIGS. 32–35 and the selective operation thereof accomplishes this goal by facilitating a subsequent more limited extension of the slide 152.

FIGS. 40 and 41 show the setting wheel 46 in more detail. The wheel comprises two separate tires 250, 252 each of which is rotationally mounted on an axle 254. The tires 250, 252 are spaced apart laterally and are longitudinally aligned with the setting stations 154, 156 of the installations heads H. The axle 254 is secured to a housing 256. A pivot shaft 258 extends laterally between and has opposite ends secured to opposite sidewalls of the housing 256. The lower end of the pivot mount 48 pivotally engages the shaft 258. The upper end of the pivot mount 48 is fixedly secured to the rear end portion of the mounting rail 4. By this arrangement, the two tires 250, 252 of the setting wheel 46, their axle 254, and the housing 256 are allowed to pivot as a unit relative the pivot mount 48 and the rail 4.

Preferably, the axle 254 is engaged by a drive chain (not shown) to drive the tires 250, 252 at the same speed as the vehicle V. This helps prevent the tires 250, 252 from exerting a forward force on markers that might tend to dislodge the markers from their deposits of glue. In the preferred embodiment, the tires are set to be raised above the road surface about ¾ of the height of the markers being installed when the tires 250, 252 are pivoted into their downwardmost position. After a marker has been set down onto the roadway by the setting ram 172 of an installation head H, the corresponding setting tire 250, 252 rides up and over the marker to push downwardly on the marker and further set it into the deposit of adhesive, as illustrated in FIG. 40. The pivotal mounting of the setting wheel housing 256 allows the tire 250, 252 to ride up and over the marker without pushing the marker forward, while the weight of the assembly 250, 252, 254, 256 provides the downward force on the marker. This helps ensure that the marker is firmly secured by the adhesive when the adhesive cures.

FIG. 42 shows a device for feeding markers into the loading chamber 140 of an installation head. In this device, a row of bottomless rectangular containers 260 are fed along a supply pathway or guide path 262 to a corner supply station having a vertical opening through which the markers are fed down into an installation head. The containers 260 may be moved along the guide path 262 by a conveying mechanism or by a spring mechanism that urges the containers 260 toward the supply station. In either case, a stop (not shown) is preferably provided to prevent the containers 260 from moving beyond the supply station. The containers 260 may accommodate round or square markers. In the latter case, the packaging of the markers in rectangular containers in preformed stacks serves to automatically orient the reflective surfaces in the proper direction. An optical sensor 264 is provided adjacent to the supply station to detect through a side opening or sensing aperture at the bottom of the container 260 when the container 260 has been emptied of markers. When this condition is detected, a ram 266 is activated to move the empty container 260 out of the supply station in a direction perpendicular to the guide path 262. The ram 266 has an engagement plate 268 that engages a projection (not shown) on the container 260. The opposite sidewall of each container 260 is preferably provided with a recess for accommodating the projection on an adjacent container 260.

The currently preferred feed device is substantially the same as the device shown in FIG. 42. One difference is that the perpendicular pathway beyond the guide path is eliminated, and an empty container is simply pushed out of the supply station by movement of the next container 260 into the supply station. The empty container 260 is discarded down into a disposal bin. A retractable gate may be provided to prevent movement of a container 260 out of the supply station before it has been emptied. This arrangement allows elimination of the ram 266 that removes the container 260 in the device shown in FIG. 42. Another change in the preferred embodiment is the elimination of the side opening or sensing aperture at the bottom of the container 260. Instead, an optical sensor 264 is simply positioned just below the bottom of the container 260 and detects the empty condition of the container 260 by the absence of a marker moving down out of the container 260 and into the feed tube 2.

As noted above, at present, the major constraint on the speed of operation of the installation apparatus of the invention is the state of the art of adhesives and adhesive application. It is currently estimated that the apparatus illustrated in FIGS. 3–5 can install road markers with a vehicle speed of about 3–4 miles per hour. The apparatus shown in FIGS. 3–5 has a single dual-nozzle dispenser manifold 90. The speed of operation can be doubled by use of a glue dispenser having two longitudinally spaced dispenser manifolds 90.

Figure 43:
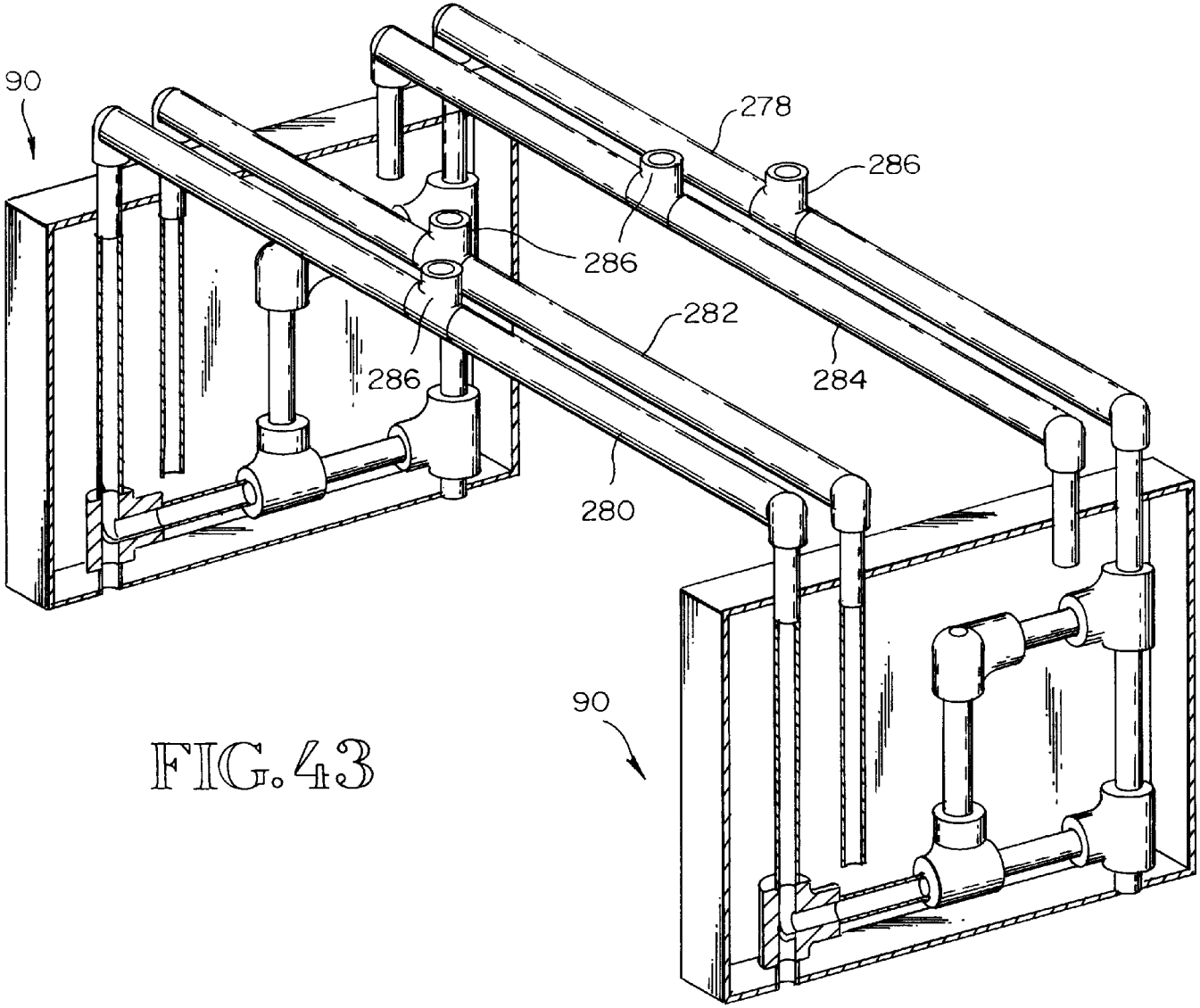
FIG. 43 is a partially schematic pictorial view of a glue dispenser with two manifolds, with parts shown in section.

A dual manifold arrangement is illustrated partially schematically in FIG. 43. Two manifolds 90 of the type shown in FIGS. 13–17 are connected together by four connecting pipes 278, 280, 282, 284. The first pipe 278 interconnects the glue inlets 92 of the two manifolds. The second pipe 280 interconnects the third glue outlets 98. The third and fourth pipes 282, 284 interconnect the hot oil inlets and the hot oil outlets, respectively. Each of the pipes 278, 280, 282, 284 has at a mid portion thereof a connector 286 to connect the pipe, and thereby connect the respective manifold inlets or outlets, to the appropriate reservoir R, F. Preferably, the pipes 278, 280, 282, 284 are dimensioned so that the center points of the first glue outlets 94 and the second glue outlets 96, respectively, are spaced apart a distance of three feet. This distance is the typical distance between the center points of longitudinally adjacent markers used to mark lanes on a roadway in patterns such as those shown in FIGS. 2A–2C.

The double manifold is preferably mounted in the type of arrangement shown in FIGS. 3–5. One of the manifolds is in the position indicated by the reference numeral 8 in FIGS. 3–5. The connecting pipes 278, 280, 282, 284 extend forwardly from this manifold 90 a distance of three feet. The second manifold is thereby positioned forwardly of the anchor subassembly 10. When the subassembly 10 moves with the dual manifold forwardly into the index position illustrated in FIGS. 3 and 5, the forward manifold slides under the shock absorber 34 and ends up, in the index position, in a position forward of the shock absorber 34. Thus, the presence of the second forward manifold does not effect the operation of the indexing of the anchor/dispenser assembly. In the operation of the dual manifold, all four dispensing valves 108, 110 may be operated simultaneously or any one or more of the valves may be operated selectively, as necessary. The simultaneous dispensing of successive deposits of glue G does not create a problem with reference to setting up of the glue before the markers are installed by the installation head H. The use of the dual manifold allows the vehicle to move at a greater speed which is sufficient to install the markers while the glue is still in an appropriate viscous condition.

FIG. 44 shows apparatus for laying road markers to form traffic indicators that extend across a lane. As shown in FIG. 44, the markers M being laid are thin flat squares having, for example, four inch sides. This type of marker is suitable for forming words, such as "left only" and for forming various symbolic indicators. Referring to FIG. 44, the apparatus includes an installation head H' and a glue dispenser 8'. These elements H' and 8' preferably have substantially the same structure as the installation head H and dispenser 8 described above and the installation head described below in reference to FIGS. 47 and 48, with modifications to the external housings to accommodate the different mounting arrangement.

The elements H' and 8' are preferably mounted on the front of a vehicle by an upper support tube 288 and a lower support tube 290. These two tubes 288, 290 are parallel to each other and extend across the front of the vehicle. Each tube 288, 290 has a telescoping sleeve arrangement including an inner sleeve 292 and an outer sleeve 294. These sleeves 292, 294 are slidable with respect to each other and with respect to the corresponding support tube 288, 290. They permit the installation head H' and the dispenser 8' to be moved laterally with respect to the front of the vehicle and with respect to each other. The use of two parallel support tubes provides a stable support structure that maintains the installation elements H', 8' parallel to the road surface.

In operation, the vehicle is stopped at a location and the laying operation begins with the elements H', 8' on a first side of the vehicle. Markers are laid by dispensing glue from the dispenser 8', ejecting markers onto the deposits of glue from the installation H', and moving the elements across the front of the vehicle, as needed. When the elements H', 8' reach the opposite side of the vehicle, the vehicle is moved forwardly to the next position in which markers are to be laid across the lane. As the vehicle moves forward, the dispenser 8' and head H' return to the first side of the vehicle. Preferably, movement of the vehicle is controlled by a drive wheel that moves against a front tire of the vehicle and is driven by a step motor to cause the vehicle to move ahead the exact predetermined distance between lateral rows of markers. The action of the step motor and drive wheel is controlled by the computer control system of the installation apparatus. By use of the apparatus shown in FIG. 44 and the method described herein, traffic indicators can be installed across lanes quickly and easily, thereby significantly reducing the cost of installation and enhancing worker safety.

FIGS. 45 and 46 illustrate a hose guide for use with the slidably mounted glue dispenser assembly of the invention. The hose guide 296 shown in FIGS. 45 and 46 may be mounted on an upper portion of the mounting rail 4 shown in FIGS. 3–5 at a longitudinally midportion of the rail 4. Referring to FIG. 45, the guide 296 includes a base 297 on which a hose support 298, 300 is mounted. The hose support 298, 300 includes a vertical leg 298 and a horizontal leg 300 pivotally mounted to the upper end of the vertical leg 298. A guide ring 302 depends downwardly from the free outer end of the horizontal leg 300. The lower end of the vertical leg 298 has a pair of opposite pivot arms 304 extending perpendicularly therefrom. These arms 304 are pivotally connected to a pivot shaft 306 to pivotally mount the vertical leg 298 on the base 297. Also mounted on the pivot shaft 306 are two opposite guide wheels 308 mounted laterally outwardly of the pivot arms 304.

Pivotal movement of the hose support 298, 300 is controlled by a cable 309. The cable 309 has a first end connected to a pin 310 carried by an upper portion of the vertical leg 298. The opposite end portion of the cable 309 extends around a semi-circular guide 311 mounted on the end of the horizontal leg 300 that is pivotally attached to the vertical leg 298. The cable end portion extends to a fixed connection 312 on the upper surface of the horizontal leg 300 closer to the ring 302 than to the vertical leg 298. Between the two connecting points 310, 312, the cable 309 extends downwardly from the pin 310, around one of the guide wheels 308 and rearwardly to a guide post 313. The cable 309 extends around the post 313 and then forwardly back to the other guide wheel 308 and up to the upper guide 311 and connection point 312. The post 313 is slidably mounted on the base 297 to permit movement of the cable 309 and thereby permit pivotal movement of the hose support 298, 300. A coil spring 314 biases the post 313 into the rear position shown in FIG. 45 to bias the support 298, 300 into the position shown in FIG. 45 and in solid lines in FIG. 46. The opposite ends of the spring 314 are secured to a rear abutment 316 and the post 313.

In use, pneumatic air hoses and other supply and return hoses connecting to the glue dispenser assembly 6 extend through the ring 302. As the assembly 6 moves rearwardly away from its index position, the hoses exert a downward and rearward pulling force on the ring 302. This causes the support legs 298, 300 to move into the extended positions shown in broken lines in FIG. 46. When the legs 298, 300 are pulled into their extended positions, the cable 309 pulls the post 313 forwardly along the guide channel 318, thereby expanding the spring 314. The spring 314 resiliently resists extension and returns the support 298, 300 to the upright position shown in FIG. 45 when the assembly 6 again returns to its index position. During movement of the assembly 6 rearwardly and forwardly along the rail 4, the use of the hose guide 296 supports and guides the supply and return hoses and prevents them from becoming entangled or interfering with proper operation of the installation apparatus.

Figure 47:
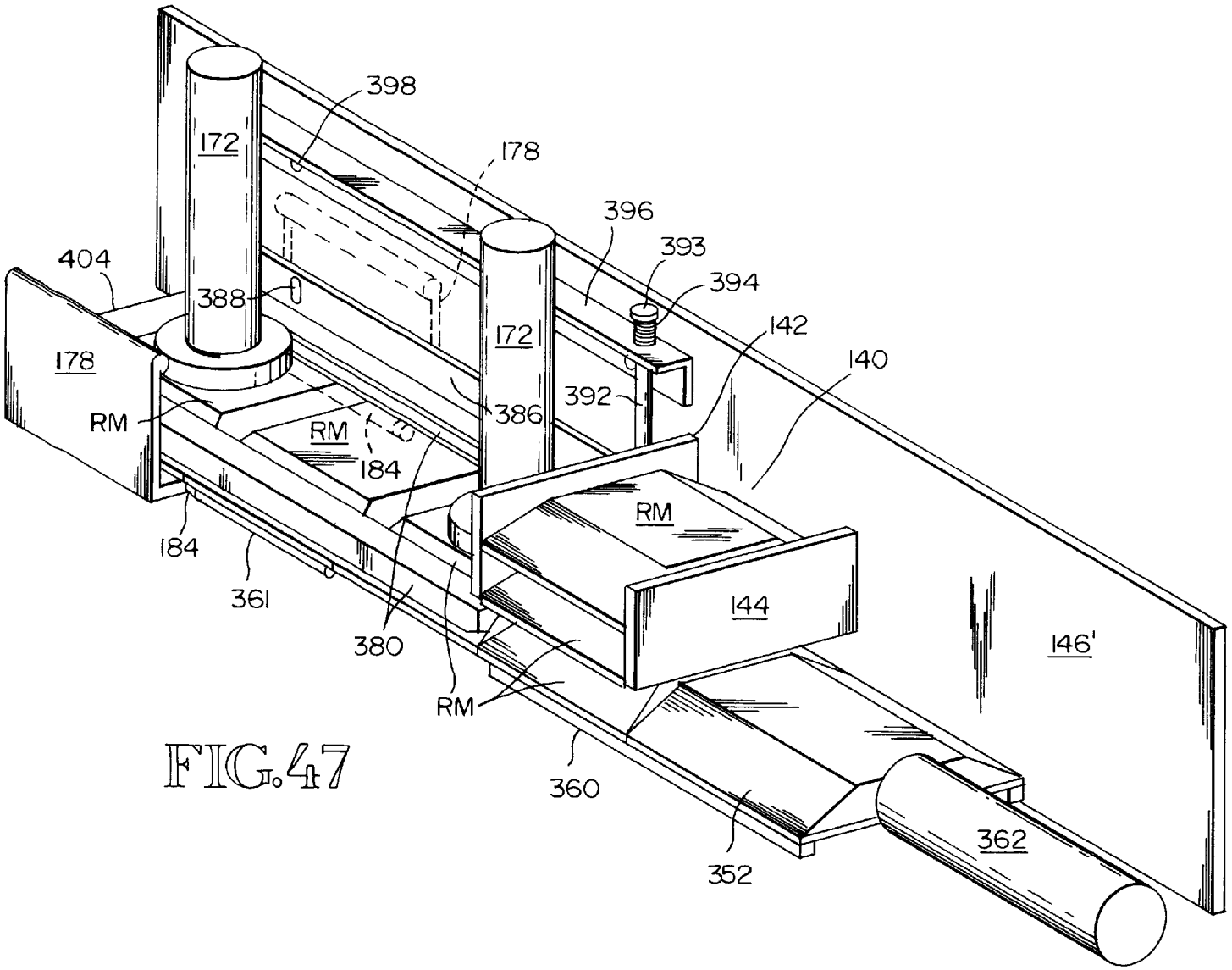
FIG. 47 is a pictorial view of a second preferred embodiment of the installation head portion of the apparatus, with foreground portions omitted and the loading chamber walls and installation head sidewall being shown with a shortened vertical height to facilitate illustration of the apparatus, and with the slide shown in a first retracted position.
Figure 48:
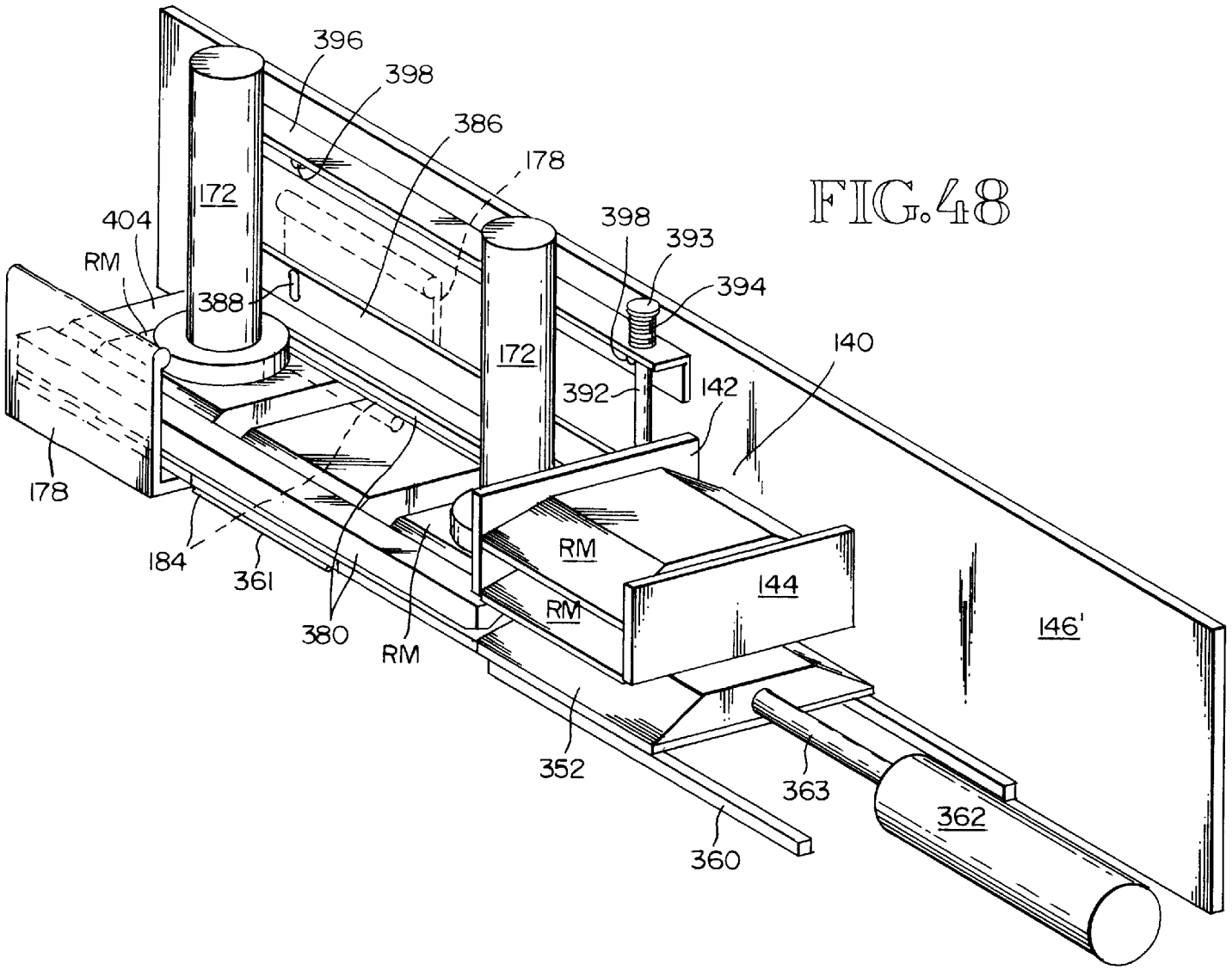
FIG. 48 is like FIG. 47 except that it shows the slide in a second extended position.

FIGS. 47 and 48 show a second embodiment of the installation head. As in FIG. 18, foreground portions are omitted to facilitate illustration. In addition, the laterally outer and laterally inner walls 142, 144 of the loading chamber 140 and the sidewall 146' of the installation head are shown with a shortened vertical height also for the purpose of facilitating illustration. The primary differences between the installation head shown in FIGS. 47 and 48 and the installation head H shown in FIG. 18 are the structure of the slide and the floor and the addition of ceiling members 380 in the head shown in FIGS. 47 and 48. Like the head H of FIG. 18, the head shown in FIGS. 47 and 48 has two setting stations 154', 156' and a setting ram 172 and a pair of bombay doors 178 at each setting station 154', 156'.

Referring to FIGS. 47 and 48, the slide 352 shown therein is much shorter in its lateral extent than the slide 152 shown in FIGS. 18 and 19. In FIGS. 47 and 48, the head is shown being used for the installation of square reflective markers RM. For use with such markers RM, the slide 352 has a configuration similar to but somewhat larger than the markers RM. In addition, the face of the slide 352 adjacent to the slide ram 362 is preferably vertical to facilitate engagement of the slide 352 by the ram 362. Unlike the slide 152 shown in FIGS. 18 and 19 and described above, the slide 352 has no opening extending therethrough and no additional portion corresponding to the square portion 170 in the slide 152. The slide 352 moves the markers RM in one direction only, the laterally outward direction. The ram 362 that moves the slide 352 laterally inwardly and outwardly has a maximum travel of about 4½ inches. The ram 362 consists of a single cylinder with a piston rod 363 that extends outwardly from the cylinder and has an outer end secured to the slide 352. The opposite laterally inner end of the cylinder is secured to an end wall of the installation head.

Figures 49, 50, 51:
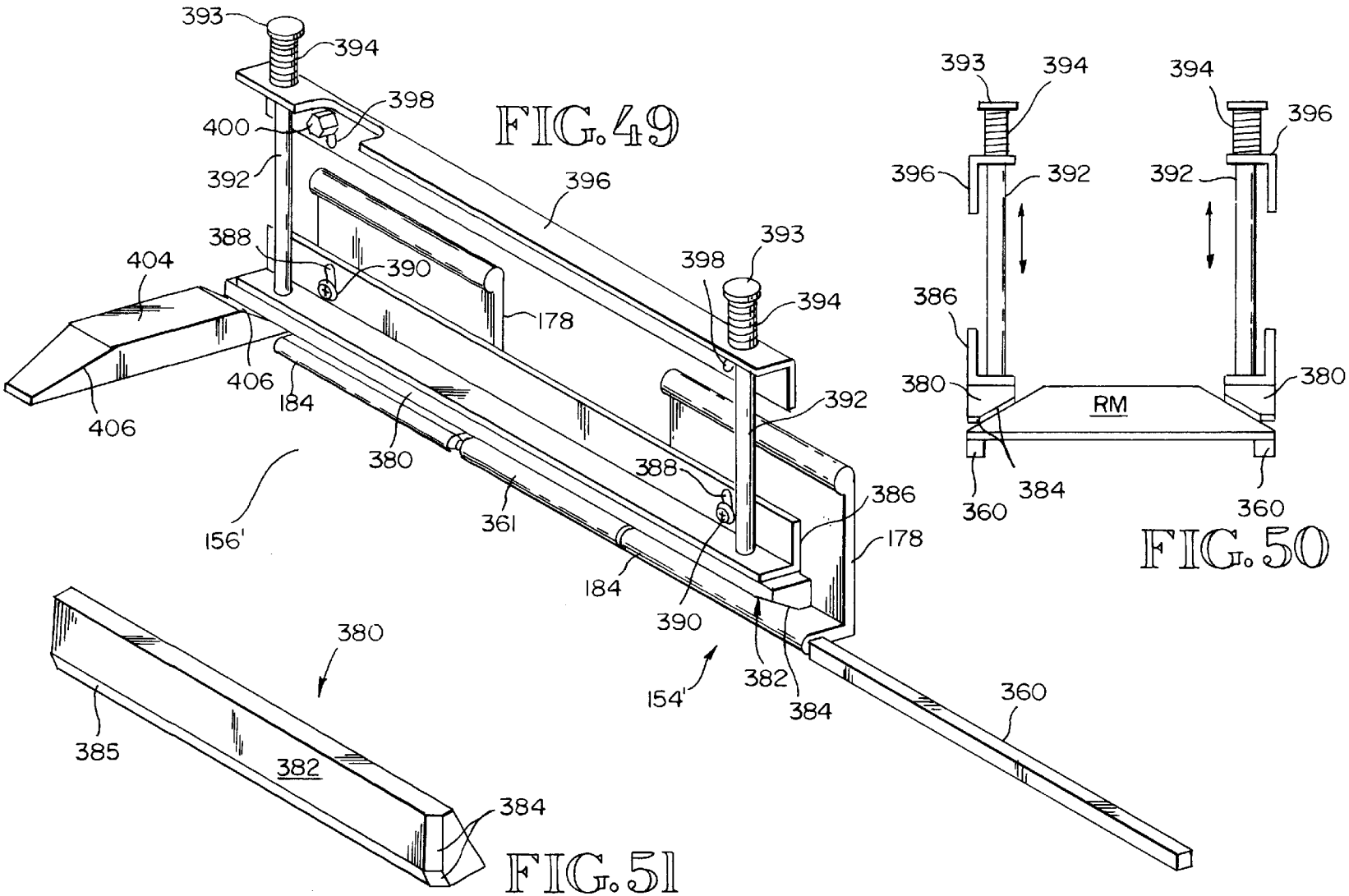
FIG. 49 is a pictorial view of portions of the apparatus shown in FIGS. 47 and 48.
FIG. 50 is an end view of the apparatus shown in FIG. 49 further including portions omitted as foreground portions in FIG. 49 and a reflective marker supported by the apparatus.
FIG. 51 is a pictorial view looking up toward lower portions of the ceiling member shown in FIGS. 47–50.

The floor 360, 361 in the head apparatus shown in FIGS. 47–50 has a more open structure than the floor shown in FIGS. 18–21 and described above. Referring to FIGS. 47–49, the floor comprises two laterally spaced portions 360, 361. The first laterally inner portion 360 comprises two parallel, spaced support members extending laterally along the opposite sidewalls 146' of the installation head. Each member 360 has a square cross section. The members 360 are positioned to support opposite edge portions of the slide 352 and a marker RM positioned in the loading chamber 140. The lateral break in the floor begins at the laterally outer end of the loading chamber 140 and extends to the laterally outer end of the first setting station 154'. In the setting station 154', the opposite edge portions of the marker RM are supported by the cylindrical end portions 184 of the respective bombay doors 178. The foreground bombay doors 178 are omitted in FIGS. 47 and 48.

The second portion 361 of the floor extends between the two setting stations 154', 156'. The portion 361 comprises two parallel, spaced support members 361 extending laterally along the opposite installation head sidewalls 146' in a co-linear relationship with the members of the first portion 360. The members of the second portion 361 have a rounded cross section to facilitate smooth sliding of markers RM along the installation head from the loading chamber 140 and setting station 154', along the floor, and into the second setting station 156'. The rounded configuration of the members of the second floor portion 361 is chosen to match the rounded configuration of the cylindrical end portions 184 of the bombay doors 178 to provide a smooth support path for the edge portions of a marker RM between the setting stations 154', 156'. The more open floor structure shown in FIGS. 47–50 has the advantage of maximized prevention of the accumulation of debris in the installation head to ensure smooth functioning of the head and sliding movement of the markers RM laterally outwardly in the head.

Referring to FIGS. 47–51, the second embodiment of the installation head has the additional feature of ceiling members 380 that are positioned to engage sloping side surfaces of the markers RM to limit vertical movement of the markers RM in the installation head. The two ceiling members 380 are parallel to each other and are spaced apart and extend along the opposite sidewalls 146' of the head laterally outwardly from the laterally inner end of the setting station 154' to a laterally outward portion of the head. The details of the structure of each ceiling member 380 can best be seen in FIGS. 49–51. The ceiling member 380 has an angled surface 382 that is positioned to engage the angled side surfaces of the markers RM. At its laterally inner end, the member 380 has two bevels 384 formed on its end adjacent to its angled surface 382 and its horizontal lower surface 385. These bevels 384 facilitate sliding movement of a marker RM from the loading station 140 into a position under the ceiling member 380. The opposite laterally outer end of the member 380 does not require beveling and is positioned adjacent to a stop 404, described further below. The outer end of the member 380 may extend over the stop 404 with some vertical clearance. Alternatively, the member 380 may terminate short of the stop 404 to leave a small lateral gap between the member 380 and the stop 404.

Each ceiling member 380 is carried by an L-shaped mounting bracket 386, shown in FIGS. 47–50. The bracket 386 is attached to the respective installation head sidewall 146' by means of two laterally spaced slots 388 through each of which extends a guide bolt 390. Each slot 388 is vertically elongated to allow vertical sliding movement of the bolt 390 in the slot 388 to, in turn, allow some vertical movement of the ceiling member 380. The vertical movement is restrained by a pair of spring rods 392 positioned on laterally opposite end portions of the horizontal leg of the mounting bracket 386. The rods 392 extend upwardly from the bracket 386 to springs 394 positioned on their upper ends.

A laterally extending L-shaped support bracket 396 extends along each head sidewall 146' above the mounting wall 174 (not shown in FIGS. 47–49) for the setting rams 172. The support brackets 396 are vertically aligned with the ceiling members 380 and their mounting brackets 386. Each support bracket 396 is secured to its respective sidewall 146' by means of two laterally spaced adjustment bolts 400 extending through corresponding slots 398 in the vertical leg of the bracket 396. In use, the bolts 400 are tightened to prevent movement of the support bracket 396 relative to the sidewall 146'. However, the vertical elongation of the slots 398 permits the bolts 400 to be loosened to adjust the vertical position of the bracket 396 and thereby adjust the spring pressure on the markers RM in the installation head. The rods 392 extend upwardly and slidably through the mounting wall 174 and the horizontal legs of the support brackets 396. A head 393 is formed on the upper end of each rod 392 and is secured to the upper end of the respective spring 394. The lower end of the spring 394 is secured to the bracket 396. Thus, the springs 394 are extended when there is upward movement of the rods 392 caused by upward movement of the markers RM due to, for example, shaking or vibration of the installation head during operation thereof. The springs 394 resist extension to thereby resist the upward movement.

Referring to FIGS. 47–49 and particularly to FIG. 49, a stop 404 is provided at the laterally outer end of the installation head. The stop extends between the opposite sidewalls 146' and has a thickness slightly less than the thickness of the markers RM. This positions the upper horizontal surface of the stop 404 slightly below the flat top surfaces of the markers RM. Adjacent to each sidewall 146', the stop 404 has an angled surface 406 that slopes downwardly from the flat top surface toward the sidewall 146'. The slope of the angled surfaces 406 is chosen to match the slope of the side surfaces of the markers RM that are adjacent to the installation head sidewalls 146'.

The operation of the installation head shown in FIGS. 47–51 is relatively simple. Markers RM are fed downwardly into the loading chamber 140 in the manner described above in connection with the installation head shown in FIG. 18. The slide 352 is reciprocated laterally outwardly and inwardly between the two positions shown in FIGS. 47 and 48 by operation of the slide ram 362. When the ram piston rod 363 is extended into the position shown in FIG. 48, the slide 352 moves into the bottom of the loading chamber 140 to push the lowermost marker RM in the chamber 140 laterally outwardly from the chamber 140 under the chamber wall 142 and into the first setting station 154'. Assuming that at the beginning of the operation both setting stations 154' and 156' and the floor area 361 therebetween are empty of markers, the slide 352 is then retracted to allow the stack of markers RM in the chamber 140 to move downwardly. Then, the piston rod 363 is again extended to push a second marker RM out from the loading chamber 140 and into the first setting station 154'. The second marker RM pushes the first marker RM out from the setting station 154' and onto the floor portion 361. Then, the retraction and extension of the slide 352 is again repeated to move a third marker RM into the setting station 154'. The movement of the third marker pushes the second marker onto the floor portion 361 and the first marker into the second setting station 156'. At this point all marker positions in the installation head are full and operation of the slide 352 is discontinued.

The abutment of the three markers RM that have been moved out of the loading chamber 140 with each other, the stop 404, and the slide 352 ensures their proper lateral placement in the installation head for setting down of the markers RM from either one or both of the setting stations 154', 156'. Following the setting down of the marker or markers RM, the slide 352 is operated to refill the setting station or stations 154', 156' that have been emptied by operation of the setting rams 172. Sensors located at each of the setting stations 154', 156' and adjacent to the floor portion 361 provide the information needed by the computer control system to determine the number of times the slide 352 is retracted and extended to refill the installation head. Prior to each setting down of markers RM onto a road surface, the three marker positions laterally outward of the loading chamber 140 are refilled by operation of the slide 352 to ensure proper lateral positioning of the markers RM. The operation of the installation head has the advantages of simplicity and a relatively short travel of the slide ram 362. The short travel helps maintain a consistent rate of travel and prevent binding of the ram 362.

Figure 52:
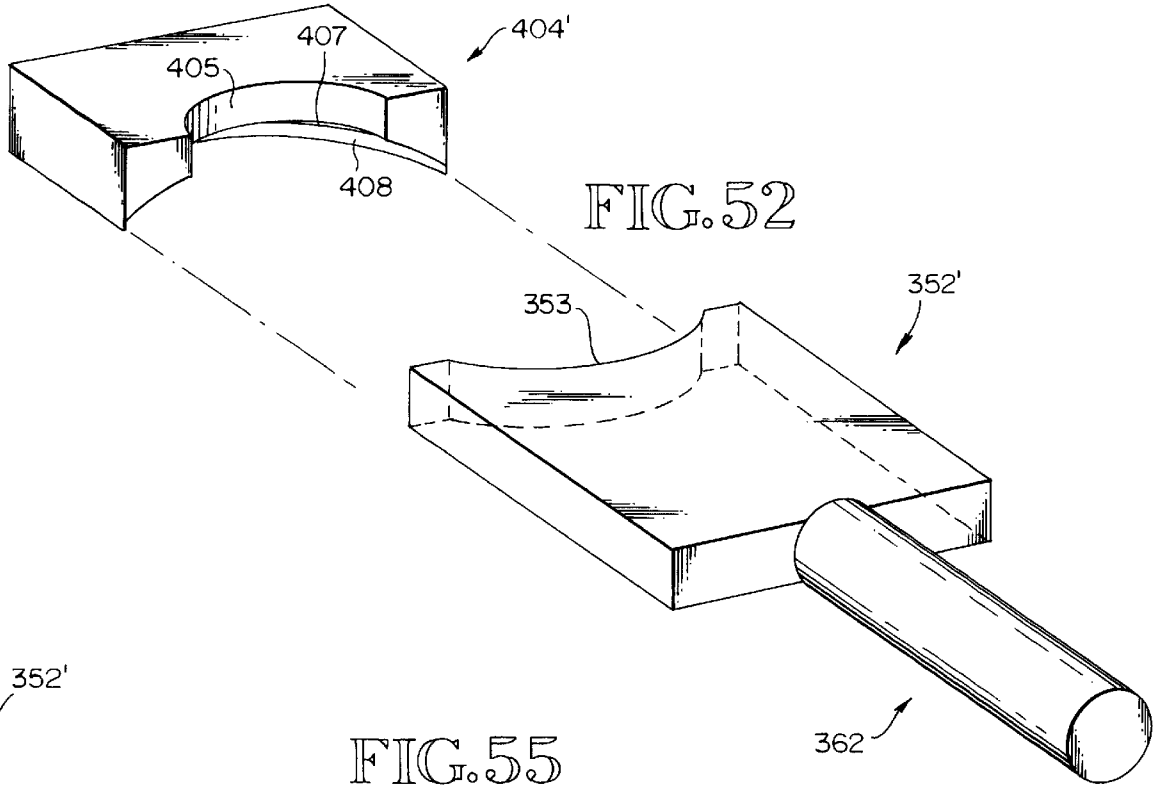
FIG. 52 is a pictorial view of a modified form of the slide and stop member shown in FIGS. 47 and 48.
Figure 53:
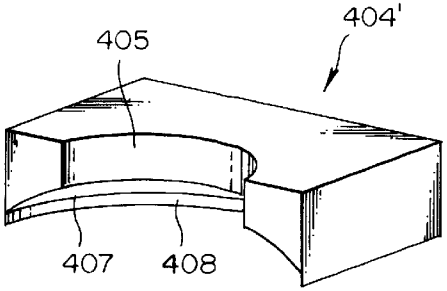
FIG. 53 is a pictorial view of the stop member shown in FIG. 52.
Figure 54:
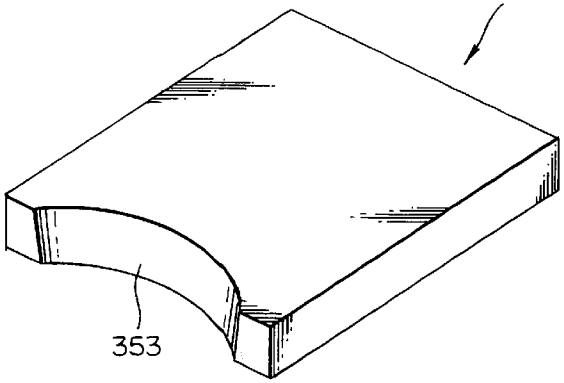
FIG. 54 is a pictorial view of the slide shown in FIG. 52 looking toward the arcuate marker-engaging end.
Figure 55:
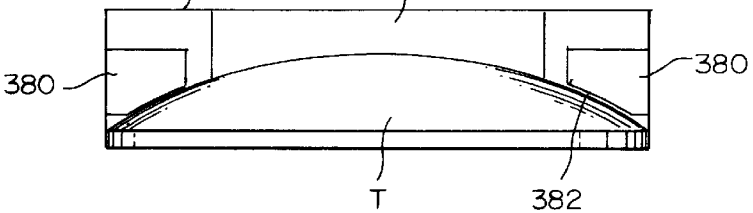
FIG. 55 is an end view of a round marker being engaged by the stop member shown in FIGS. 52 and 53 and the ceiling members shown in FIGS. 47–50.

FIGS. 52–55 show a modified form of the slide 352' and stop 404' for use with round markers T. Referring to FIGS. 52 and 54, the slide 352' has a vertical arcuate surface 353 formed on its laterally outer end. This arcuate surface 353 is configured to engage the rounded marker T. The stop 404' has a structure similar to the stop member 204 shown in FIG. 28 and described above. Referring to FIGS. 52, 53, and 55, the stop member 404' has an arcuate configuration confronting the arcuate surface 353 of the slide 352'. The arcuate end of the stop 404' includes an upper vertical surface 405, an intermediate angled surface 407, and a lower vertical surface 408. When a marker T is moved into the second setting station 156', the edge of the marker T moves into engagement with the arcuate surfaces 407, 408 and is held in engagement therewith by the slide 352'. This holds the marker T in the correct position in alignment with the setting ram 172 and helps prevent tilting of the marker T. In addition, the ceiling members 380 extend laterally outwardly and terminate at the stop 404' to provide further resistance to tilting of the marker T. The ceiling members 380 also permit the use of the ram head 202 shown in FIGS. 28 and 29 for either round markers T or square, flat-topped reflective markers RM. This, in turn, provides tolerance of rotational movement of the setting ram 172 about its vertical axis and horizontal displacement of the axis.

Figure 57:
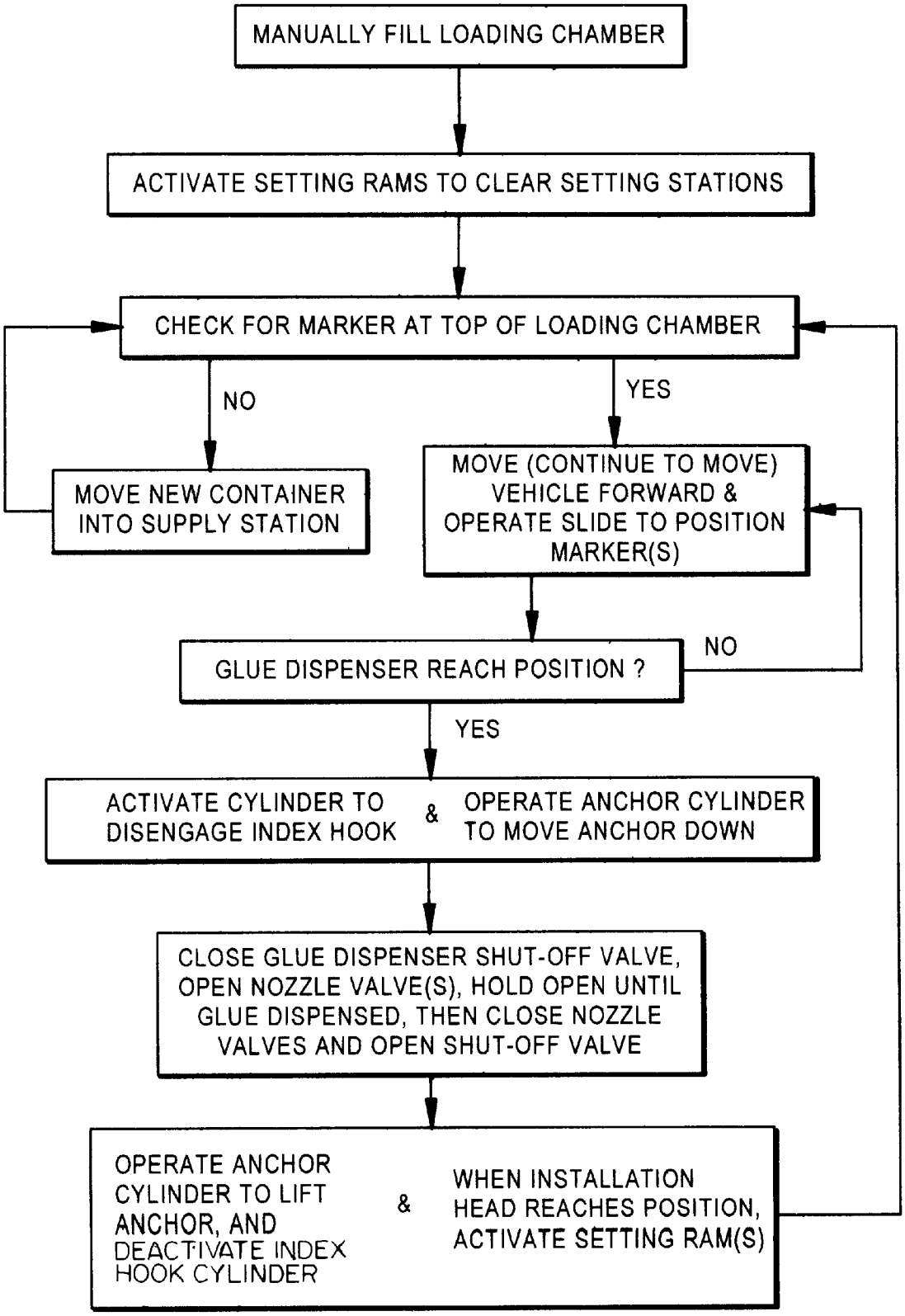
FIG. 57 is a flow chart of the operation of the apparatus shown in FIGS. 3–5.

FIG. 57 is a flow chart showing the basic steps of the operation of the preferred embodiment of the apparatus of the invention that is shown in FIGS. 3–5 and is designed for installing markers along a line that separates lanes on a roadway. Referring to FIG. 57, an initial step is the filling of the loading chamber 140 of the installation head H. This initial filling of the loading chamber 140 is done manually to ensure that the markers are correctly positioned and none of the markers are tilted or are otherwise in an incorrect orientation. When the loading chamber 140 is empty, it cannot reliably be filled automatically from a container 260 positioned above the loading chamber 140 since the markers are likely to tip and flip over when moving down through the chamber 140 to the bottom of the chamber 140 defined by the installation head floor 160, 360, 361. When the loading chamber 140 has been filled, the setting rams 172 are activated to clear the setting stations 154, 154', 156, 156'. This is done to ensure that no undesired markers from previous operations remain in the setting stations 154, 154', 156, 156'. The initial clearing of the setting stations 154, 154', 156, 156' and the subsequent steps for installing markers are controlled by a computer under the supervision of an operator.

When the loading chamber 140 has been filled and the setting stations 154, 154', 156, 156' have been cleared, the computer program checks the sensor positioned just below the container 260 in the supply station illustrated in FIG. 42 to ensure that there is a marker at the top of the loading chamber 140 just below the bottom of the container 260. If no marker is present, the gate at the downstream end of the supply station is lowered and the biasing or conveying means of the feed device is operated to move a new full container into the supply station. As soon as the new container 260 has entered the supply station, the gate is raised to prevent it from moving beyond the station. Then, the computer again checks for a marker at the top of the loading chamber 140. When a marker is detected, the installation operation can proceed.

For installation of the initial marker in a line of markers, the vehicle is initially positioned in a ready position in which the glue dispenser 8 is slightly rearward of the first marker position. When the marker has been sensed at the top of the loading chamber 140, the vehicle moves forward. As the vehicle V begins to move forward, the slide ram 162, 362 is operated to move the slide 152, 352 and position markers in the setting stations 154, 154', 156, 156'. The vehicle moves forward until the glue dispenser assembly 6 has reached a position in which the centers of the outlet nozzles 94, 96 are above the center of the lane divider location where the first marker(s) are to be installed.

When the computer determines that the vehicle V has moved forward the correct distance to so position the outlet nozzles 94, 96, the index hook cylinder 32 is activated to move the index hook 28 away from the shock absorber shoulder 44. At the same time, the anchor cylinder 60 is operated to move the anchor down into a position in which it engages the roadway to prevent further movement of the glue dispenser assembly 6 relative to the roadway. When movement of the assembly 6 has been arrested, the dispenser shut-off valve 129 is closed to build pressure in the manifold 90. Then, the flow control (nozzle) valves 108, 110 are selectively opened, as required by the installation pattern, and held open for a brief period sufficient to allow the correct amount of glue to be deposited onto the roadway. When the glue has been deposited, the nozzle valves 108, 110 are closed and the shut-off valve is opened. Then, the anchor cylinder 60 is operated to lift the anchor 14, and the index hook cylinder 32 is deactivated. In addition, when the installation head H reaches a position such that the setting stations 154, 154', 156, 156' are aligned above the deposit(s) of glue that have been dispensed, the appropriate setting ram(s) 172 are activated to force the required markers down onto the deposits of glue. After the markers have been set down by the rams 172, the process is repeated for installing markers at subsequent locations along the lane divider line. For the subsequent locations, the initial steps of manually filling the loading chamber 140 and activating the setting rams 172 to clear the setting stations 154, 154',156, 156' need not be repeated. The computer returns to the step at which it checks for the presence of a marker at the top of the loading chamber 140. It should be noted that during normal operation of the apparatus, once the vehicle V has moved from its initial ready position, movement of the vehicle remains continuous as the markers are laid along the divider line.

When the anchor 14 is raised away from the roadway, the pneumatic pressure in the pressure chamber 21 of the return cylinder 20 automatically moves the assembly 6 back to its index position. As the assembly 6 moves into its index position, it contacts piston 36 of the shock absorber 34 and forces the piston 36 to retract. At the same time, the index hook 28 slides over the bottom of the shock absorber 34 until the hooking surface clears the shoulder 44. When this occurs, the spring return of the cylinder 32 moves the hook 28 upwardly to allow the hooking surface to engage the shoulder 44. The piston 36 of the shock absorber 34 pushes back on the assembly 6 to firmly engage the hooking surface against the shoulder 44. This ensures that the assembly 6 is in the correct position for laying markers at the next location.

The automatic operation of the apparatus requires the use of a number of sensors. These sensors include the sensor located just below the supply station for detecting a marker at the top of the loading chamber 140 and sensors at installation head locations 154, 156, 154', 361, 156' for detecting the presence or absence of markers in the locations. This information is needed to allow the computer to determine how to operate the slide ram 162, 362 to move markers into desired locations that are empty. They also include a sensor to accurately determine the forward distance traveled by the vehicle V to thereby ensure that the assembly 6 and installation heads H are properly positioned for glue dispensing and marker ejection. In addition, the system preferably includes a number of sensors to continuously verify that the elements of the apparatus are functioning properly. Such sensors may be used, for example, to verify that the assembly 6 has moved into its index position and to verify that the setting rams 172 are functioning properly. Each of the sensors used in the system may be of various known types.

The above discussion of the operation of the system of the invention has focused on the installation of markers in new road construction. The system of the invention may also be used advantageously in repair operations to replace broken or missing markers on an existing roadway. In such an operation, a vehicle, such as the trailer V shown in FIG. 1, is moved along the roadway adjacent to the line of markers. The trailer V preferably has a plurality of installation heads for laying different types of markers. A sensor at the front end of the vehicle detects the occurrence of missing or broken markers. When a missing marker is detected, the operator determines what type of marker is required and activates the system to install a replacement marker. When a broken marker is detected, the broken marker must first be removed before a new marker can be installed.

FIG. 56 illustrates apparatus carried by a front portion of the vehicle for removal of damaged markers. The apparatus includes a scraper 320 and a vacuum tube 322 with a flared lower end 324. The scraper 320 has a pointed forward end that is urged under the adhesive body 326 holding the damaged marker T to separate the adhesive 326 from the pavement and free the marker T. The scraper 320 is preferably part of a vibrating device similar to an electric jack hammer to facilitate the breaking of the adhesive bond. The freed marker T and removed adhesive and other associated debris are sucked up into the vacuum tube 322 into a waste container. Then, the vehicle is moved into position to install a new marker to replace the damaged one. The flared lower end 324 of the vacuum unit is sufficiently flexible to allow the unit to move over additional road markers in its path. The scraper 320 must be retracted between removal procedures.

Although the preferred embodiment of the invention has been illustrated and described herein, it is intended to be understood that various modifications and omissions in form and detail may be made without departing from the spirit and scope of the invention as defined by the following claims.

What is claimed:

1. Apparatus for installing raised road markers on a roadway, comprising:

a longitudinally extending mounting rail attachable to a vehicle and having opposite first and second end portions;

an installation head mountable on the vehicle in a position fixed relative to said rail and adjacent to said first end portion, said installation head having a setting station from which markers may be dispensed down onto a roadway;

a glue dispenser assembly slidably mounted on said rail; said assembly including a dispenser having a nozzle through which glue may be ejected onto a roadway, an anchor having a down position in which it engages a roadway along which the vehicle is traveling and an up position in which it is out of engagement with the roadway, and an anchor actuator operatively connected to said anchor to move said anchor between said down and up positions; and said assembly having a forward index position on said second end portion of said rail; and a return actuator operatively connected to said assembly to allow said assembly to slide rearwardly along said rail from said index position toward said installation head when said anchor is moved into its down position, and to positively move said assembly forwardly along said rail to return said assembly to said index position when said anchor is moved into its up position.

2. The apparatus of claim 1, further comprising a shock absorber fixed relative to said rail and positioned to cushion and arrest sliding movement of said assembly as said assembly slides forwardly into said index position.

3. The apparatus of claim 2, wherein said return actuator comprises a single acting pneumatic cylinder having a pressure chamber continuously connected to a source of pressure to continuously bias said assembly toward said index position.

4. The apparatus of claim 3, comprising a piston head slidable within said cylinder and defining one end of said pressure chamber, and a flexible cable having one end secured to said piston head and a second opposite end secured to said assembly.

5. The apparatus of claim 2, comprising an indexing hook component and a hook engagement component; one of said components being carried by said assembly, and the other of said components being carried by said shock absorber; said hook component being positioned to engage said engagement component as said assembly moves into said index position to accurately locate and maintain said assembly in said index position until said anchor is moved into its down position.

6. The apparatus of claim 1, wherein said return actuator comprises a single acting pneumatic cylinder having a pressure chamber continuously connected to a source of pressure to continuously bias said assembly toward said index position.

7. The apparatus of claim 1, comprising an indexing hook component and a hook engagement component; one of said components being carried by said assembly, and the other of said components being positioned adjacent to said index position of said assembly; said hook component being positioned to engage said engagement component as said assembly moves into said index position to accurately locate and maintain said assembly in said index position until said anchor is moved into its down position.

8. The apparatus of claim 1, wherein said dispenser has a pair of laterally spaced nozzles and is operable to dispense glue from either of said nozzles or from both of said nozzles simultaneously; and said head has a pair of laterally spaced setting stations longitudinally aligned with said pair of nozzles.

9. The apparatus of claim 8, wherein said head includes a slide laterally slidable to move markers from a loading station into said setting stations.

10. The apparatus of claim 9, wherein said head includes a pair of setting rams, one at each setting station, each said ram being operable to force a marker in its corresponding setting station down onto a deposit of glue dispensed by said dispenser onto a roadway.

11. The apparatus of claim 10, further comprising a setting wheel mounted on said vehicle rearwardly of said head, said wheel being positioned to ride up over a marker that has been forced down onto a deposit of glue by one of said setting rams.

12. The apparatus of claim 8, wherein said head includes a pair of setting rams, one at each setting station, each said ram being operable to force a marker in its corresponding setting station down onto a deposit of glue dispensed by said dispenser onto a roadway.

13. The apparatus of claim 1, wherein said head includes a setting ram operable to force a marker in said setting station down onto a deposit of glue dispensed by said dispenser onto a roadway.

14. The apparatus of claim 13, further comprising a setting wheel mounted on said vehicle rearwardly of said head, said wheel being positioned to ride up over a marker that has been forced down onto a deposit of glue by said setting ram.

15. The apparatus of claim 1, further comprising a setting wheel mounted on said vehicle rearwardly of said head, said wheel being positioned to ride up over a marker that has been dispensed from said setting station down onto a deposit of glue on a roadway to urge the marker into the deposit of glue.

* * * * *